US010615477B2

(12) United States Patent
Suenaga et al.

(10) Patent No.: US 10,615,477 B2
(45) Date of Patent: Apr. 7, 2020

(54) DIFFERENTIAL SIGNAL TRANSMISSION CABLE, MULTI-CORE CABLE, AND MANUFACTURING METHOD OF DIFFERENTIAL SIGNAL TRANSMISSION CABLE

(71) Applicant: Hitachi Metals, Ltd., Tokyo (JP)

(72) Inventors: Kazufumi Suenaga, Tokyo (JP); Setsuo Andoh, Tokyo (JP); Hisashi Tate, Tokyo (JP); Yuju Endo, Tokyo (JP); Takahiro Sugiyama, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 85 days.

(21) Appl. No.: 15/965,062

(22) Filed: Apr. 27, 2018

(65) Prior Publication Data

US 2019/0013559 A1 Jan. 10, 2019

(30) Foreign Application Priority Data

Jul. 4, 2017 (JP) ..... 2017-131107

(51) Int. Cl.
*H01P 3/06* (2006.01)
*H01P 11/00* (2006.01)
(Continued)

(52) U.S. Cl.
CPC ..... *H01P 3/06* (2013.01); *H01B 3/441* (2013.01); *H01B 11/1058* (2013.01);
(Continued)

(58) Field of Classification Search
CPC ..... H01P 3/06
(Continued)

(56) References Cited

U.S. PATENT DOCUMENTS

2004/0026101 A1 2/2004 Ochi
2015/0162113 A1 6/2015 Ishikawa et al.
(Continued)

FOREIGN PATENT DOCUMENTS

JP 2002289047 A1 10/2002
JP 2005149892 A1 6/2005
(Continued)

OTHER PUBLICATIONS

Notice of Reasons for Rejection dated Aug. 1, 2017 in corresponding Japanese Patent Application No. 2017-131107, and its English translation.

*Primary Examiner* — Stanley Tso
(74) *Attorney, Agent, or Firm* — David D. Brush; Westman, Champlin & Koelher, P.A.

(57) ABSTRACT

Provided is a differential signal transmission cable, a multi-core cable, and a method of manufacturing a differential signal transmission cable that can suppress an increase in differential-to-common mode conversion quantity. The differential signal transmission cable includes two signal lines, an insulation layer covering a periphery of the two signal lines, and a plating layer covering the insulation layer. Differential-to-common mode conversion quantity of the differential signal transmission cable has a maximum value of −26 dB or less, in a frequency band of 50 GHz or less. In the method of manufacturing a differential signal transmission cable, dry ice blasting is performed on an outer peripheral surface of the insulation layer, and then corona discharge exposure is performed on the outer peripheral surface.

20 Claims, 23 Drawing Sheets

(51) Int. Cl.

| | |
|---|---|
| ***H01B 13/22*** | (2006.01) |
| ***H01B 3/44*** | (2006.01) |
| ***H01B 11/18*** | (2006.01) |
| ***H01B 11/10*** | (2006.01) |
| *H01B 7/02* | (2006.01) |
| *H01B 11/04* | (2006.01) |

(52) U.S. Cl.
CPC ..... *H01B 11/1895* (2013.01); *H01B 13/222* (2013.01); *H01P 11/005* (2013.01); *H01B 7/0216* (2013.01); *H01B 11/04* (2013.01)

(58) Field of Classification Search
USPC ..... 174/113 R
See application file for complete search history.

(56) References Cited

U.S. PATENT DOCUMENTS

| | | | | |
|---|---|---|---|---|
| 2015/0170794 | A1* | 6/2015 | Mutnury ..... | H01B 7/17<br>174/105 R |
| 2015/0371736 | A1* | 12/2015 | Sugiyama ..... | H01B 3/30<br>174/113 R |
| 2016/0111187 | A1 | 4/2016 | Kodama | |

FOREIGN PATENT DOCUMENTS

| | | | |
|---|---|---|---|
| JP | 2015111529 | A1 | 6/2015 |
| JP | 2016081824 | A1 | 5/2016 |

* cited by examiner

| STRUCTURAL PARAMETER | CALCULATED VALUE |
|---|---|
| (100)ORIENTATION DEGREE $O_{100}$ | 0.269 |
| (110)ORIENTATION DEGREE $O_{110}$ | 0.731 |

| STRUCTURAL PARAMETER | CALCULATED VALUE |
|---|---|
| (100)ORIENTATION DEGREE $O_{100}$ | 0.256 |
| (110)ORIENTATION DEGREE $O_{110}$ | 0.744 |

DIFFERENTIAL SIGNAL TRANSMISSION CABLE, MULTI-CORE CABLE, AND MANUFACTURING METHOD OF DIFFERENTIAL SIGNAL TRANSMISSION CABLE

CROSS-REFERENCE TO RELATED APPLICATIONS

This application claims the benefit of Japanese Patent Application No. 2017-131107 filed on Jul. 4, 2017 with the Japan Patent Office, the entire disclosure of which is incorporated herein by reference.

BACKGROUND

The present disclosure relates to a differential signal transmission cable, a multi-core cable, and a method of manufacturing a differential signal transmission cable.

Conventionally, a differential signal transmission cable is used for signal transmission between electronic devices or between substrates in electronic devices. Examples of the electronic devices include servers, routers, and storage products that handle high-speed signals of several Gbps or more. A differential signal transmission cable has two signal lines (see, for example, Japanese Unexamined Patent Application Publication No. 2002-289047).

Using a differential signal transmission cable, signal transmission by differential signal can be sent to a receiving side. In the signal transmission by differential signal, two individual signals of opposite phases are input to two signal lines of the differential signal transmission cable. The receiving side synthesizes a difference between the two individual signals of opposite phases to acquire a differential output.

SUMMARY

A conventional differential signal transmission cable comprises an insulation layer covering a periphery of each signal line and a metal foil tape wound around an outer circumference of the insulation layer. There may be a gap between the outer peripheral surface of the insulation layer and the metal foil tape due to loosening of the metal foil tape or the like. When such a gap is generated, there is a difference in propagation time between the two signal lines. This phenomenon is called internal skew. When internal skew occurs, differential components of the signals transmitted through the two signal lines are converted into common-mode components. Therefore, waveform degradation of the output acquired by the receiving side becomes conspicuous.

In one aspect of the present disclosure, it is desirable to provide a differential signal transmission cable, a multi-core cable, and a method of manufacturing a differential signal transmission cable that can suppress an increase in a differential-to-common mode conversion quantity.

One aspect of the present disclosure provides a differential signal transmission cable comprising two signal lines, an insulation layer covering a periphery of the two signal lines, and a plating layer covering the insulation layer, differential-to-common mode conversion quantity of the differential signal transmission signal having a maximum value of −26 dB or less, in a frequency band of 50 GHz or less.

According to the differential signal transmission cable in one aspect of the present disclosure, the differential-to-common mode conversion quantity can be reduced.

Another aspect of the present disclosure provides a multi-core cable comprising a plurality of differential signal transmission cables, a conductor layer bundle-covering the plurality of differential signal transmission cables, and a jacket covering the conductor layer, each of the plurality of differential signal transmission cables being a multi-core cable comprising a differential signal transmission cable according to one aspect of the present disclosure and an outer insulation layer covering the plating layer.

According to the multi-core cable in another aspect of the present disclosure, the differential-to-common mode conversion quantity can be reduced.

Another aspect of the present disclosure provides a method of manufacturing a differential signal transmission cable comprising two signal lines, an insulation layer covering a periphery of the two signal lines, and a plating layer covering the insulation layer, the method comprising: performing dry ice blasting on an outer peripheral surface of the insulation layer; performing corona discharge exposure on the outer peripheral surface; and then forming the plating layer on the outer peripheral surface. Dry ice blasting corresponds to a surface roughening treatment. Corona discharge exposure corresponds to a surface modification treatment.

According to the method of manufacturing a differential signal transmission cable according to another aspect of the present disclosure, a differential signal transmission cable having a small differential-to-common mode conversion quantity can be manufactured.

BRIEF DESCRIPTION OF THE DRAWINGS

Embodiments of the present disclosure will be described hereinafter by way of example with reference to the accompanying drawings, in which.

DETAILED DESCRIPTION OF THE PREFERRED EMBODIMENTS

1. Differential Signal Transmission Cable (1-1) Basic Configuration of Differential Signal Transmission Cable A differential signal transmission cable of the present disclosure comprises two signal lines, an insulation layer covering a periphery of the two signal lines, and a plating layer covering the insulation layer.

Figure 1:
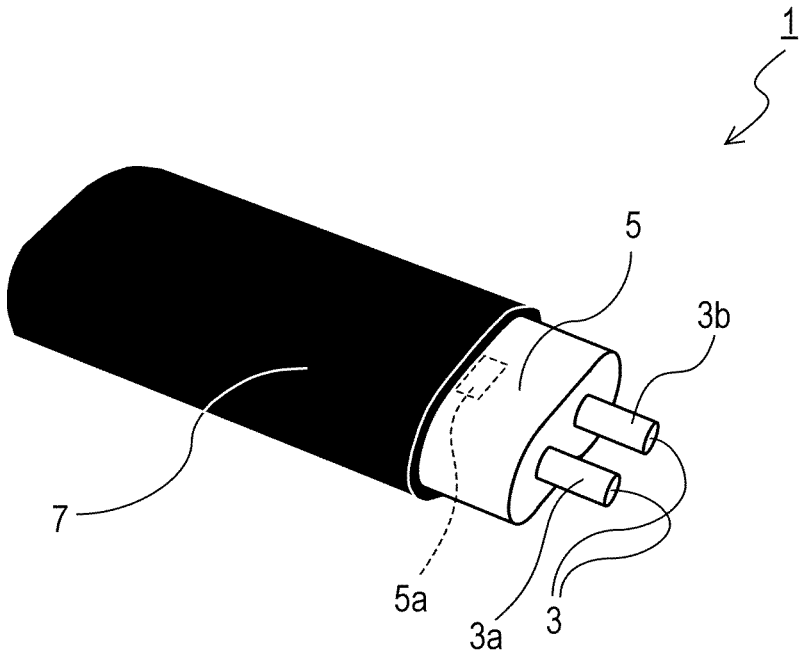
FIG. 1 is a perspective view showing a configuration of a differential signal transmission cable.

As shown in FIG. 1, a differential signal transmission cable 1 comprises two signal lines 3, an insulation layer 5, and a plating layer 7. The insulation layer 5 covers a periphery of the two signal lines 3. In the example shown in FIG. 1, the insulation layer 5 bundle-covers the two signal lines 3 (specifically, first signal line 3*a* and second signal line 3*b*). The two signal lines 3*a*, 3*b* have the same configuration. Hereinafter, the signal line 3*a* will be described as appropriate. The signal line 3*a* is composed of, for example, a strand. The signal line 3*a* may be, for example, a twisted wire formed by twisting a plurality of strands. In the case of a twisted wire, flexibility of the signal line 3*a* is improved.

In the differential signal transmission cable 1 of the present disclosure, differential-to-common mode conversion quantity preferably has a maximum value of −26 dB or less, in a frequency band of 50 GHz or less. The differential-to-common mode conversion quantity is measured before the differential signal transmission cable 1 is wound around a drum or the like. In the differential signal transmission cable 1 of the present disclosure, a gap is less likely to be formed between the plating layer 7 and the insulation layer 5. Therefore, the differential signal transmission cable 1 of the present disclosure has a low differential-to-common mode conversion quantity.

The differential signal transmission cable 1 of the present disclosure can be used, for example, for signal transmission between electronic devices, signal transmission between substrates in an electronic device, or the like. Examples of electronic devices include servers, routers, and storage products that handle high-speed signals of several Gbps or more. Further, the differential signal transmission cable 1 of the present disclosure can be used, for example, as an acoustic cable. The differential signal transmission cable 1 of the present disclosure may be, for example, a cable that transmits a high-speed signal of 25 GHz or higher.

(1-2) Insulation Layer

It is preferable that the insulation layer 5 "bundle-covers" the two signal lines 3. "Bundle-cover" means covering two signal lines collectively with a single insulation layer. When each signal line is covered with a separate insulation layer ("individual covering"), a gap may be generated between two insulation layers.

When an insulation layer bundle-covers two signal lines (simultaneously), such a gap is not generated. In bundle-covering, variation in dielectric constant in a longitudinal direction of the differential signal transmission cable can be suppressed. As a result, an increase in differential-to-common mode conversion quantity can be further suppressed.

Further, when the insulation layer bundle-covers the two signal lines, a more uniform plating layer can be formed on an outer peripheral surface of the insulation layer. In addition, the insulation layer covering a first signal line of the two signal lines and the insulation layer covering a second signal line may be separate bodies, as described above.

Figure 20:
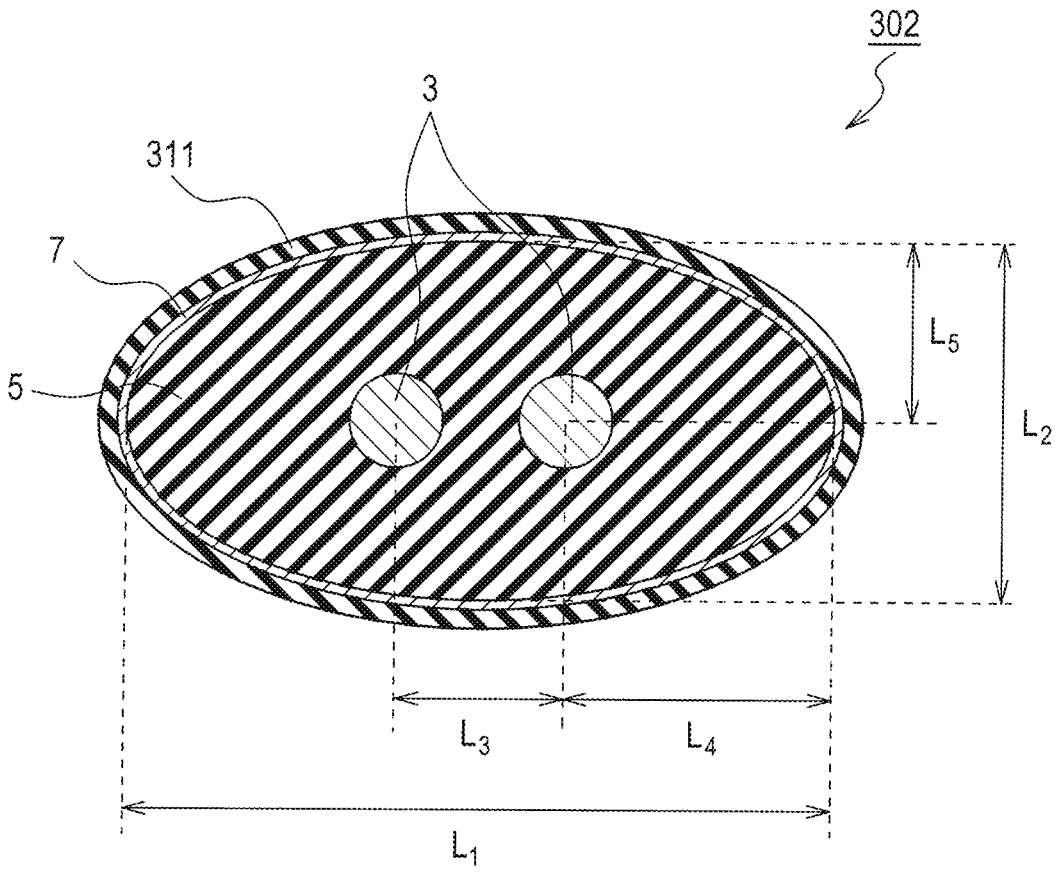
FIG. 20 is a cross-sectional view showing a configuration of a differential signal transmission cable included in a multi-core cable.

In a cross section orthogonal to an extending direction of the two signal lines, an outer edge of the insulation layer is preferably substantially in an oval or elliptical shape. In this case, it is easy to form the plating layer uniformly over the entire outer peripheral surface of the insulation layer. In addition, surface roughening treatment and surface modification treatment can be performed uniformly over the entire outer peripheral surface of the insulation layer. The oval shape may be a shape comprising two opposing parallel straight lines and circular arcs connecting ends of the straight lines. In the specification and the claims, "oval" is defined broadly as including: an ellipse, two parallel straight lines connected by semi-circular arcs (creating two opposing flat surfaces in the cable), an egg shape, and a circle. For example, the embodiment in FIG. 1 illustrates opposing flat surfaces, and the embodiment in FIG. 20 illustrates an approximate ellipse.

An arithmetic average roughness Ra on the outer peripheral surface of the insulation layer is preferably 0.6 μm or more. In this case, adhesion between the plating layer and the insulation layer is high, and the plating layer hardly peels off from the insulation layer. In addition, when the arithmetic average roughness Ra is 0.6 μm or more, adhesion between the insulation layer and the plating layer is improved, and a gap is less likely to be formed between the insulation layer and the plating layer. Therefore, an increase in differential-to-common mode conversion quantity can be further suppressed.

A method for setting the arithmetic average roughness Ra on the outer peripheral surface of the insulation layer to 0.6 μm or more includes, for example, performing surface roughening treatment such as blasting, immersion in acidic or alkaline solution, immersion in chromic acid solution, immersion in chelate solution, and the like.

Examples of powder to be blown onto a target to be treated in blasting include powder containing dry ice, metal particles, carbon particles, oxide particles, carbide particles, nitride particles, and the like. The powder containing dry ice is preferred because it hardly remains in the insulation layer after blasting.

In blasting, the higher the powder ejecting speed is, the larger the arithmetic average roughness Ra on the outer peripheral surface of the insulation layer can be made. The longer the blasting time is, the larger the arithmetic average roughness Ra on the outer peripheral surface of the insulation layer can be made. The smaller the distance between the tip of a nozzle for spraying powder and the outer peripheral surface of the insulation layer is, the larger the arithmetic average roughness Ra on the outer peripheral surface of the insulation layer can be made.

The arithmetic average roughness Ra on the outer peripheral surface of the insulation layer is preferably 10 μm or less, more preferably 5 μm or less. When the arithmetic average roughness Ra is 10 μm or less, transmission loss can be suppressed.

A method of measuring the arithmetic average roughness Ra may use a laser microscope VK8500 manufactured by Keyence Corporation. Specific measurement conditions are as follows. Two places (hereinafter referred to as a first measurement position 5*a* and a second measurement position (not shown)) on the outer peripheral surface of the insulation layer, that are located on opposite sides and are flat or have the smallest curvature, are selected. At the first measurement position 5*a*, a rectangular measurement region having a longitudinal length of the cable of 150 μm and a circumferential length of the cable of 120 μm is set. In the measurement region, the arithmetic average roughness Ra is measured using the above laser microscope. Also at the second measurement position, the arithmetic average roughness Ra is measured in the same manner. Finally, an average value of the arithmetic average roughness Ra at the first measurement position 5*a* and the arithmetic average roughness Ra at the second measurement position is calculated, and the average value is set to be the arithmetic average roughness Ra on the outer peripheral surface of the insulation layer. The arithmetic average roughness Ra may be a value at the time before the plating layer is formed.

The following test (hereafter referred to as the first test) confirmed that the plating layer is not easily separated from the insulation layer when the arithmetic average roughness Ra on the outer peripheral surface of the insulation layer is 0.6 μm or more. A substrate made of polyethylene was prepared. This substrate corresponds to the insulation layer. Blasting using dry ice as powder (hereinafter referred to as dry ice blasting) was performed on the substrate. Dry ice blasting corresponds to surface roughening treatment. An arithmetic average roughness Ra of the surface of the substrate after dry ice blasting was 0.6 μm or more. Thereafter, the substrate was subjected to corona discharge exposure as surface modification treatment. Treatment such as electron beam irradiation, ion irradiation, corona discharge exposure, plasma exposure, ultraviolet irradiation, X-ray irradiation, γ-ray irradiation, immersion in ozone-containing liquid or the like may be performed as surface modification treatment. An adhesion wetting surface free energy of the surface of the substrate after corona discharge exposure was 66 mJ/m$^2$ or more, and a contact angle was 95° or less. A method of measuring adhesion wetting surface free energy will be described later.

Figure 2A:
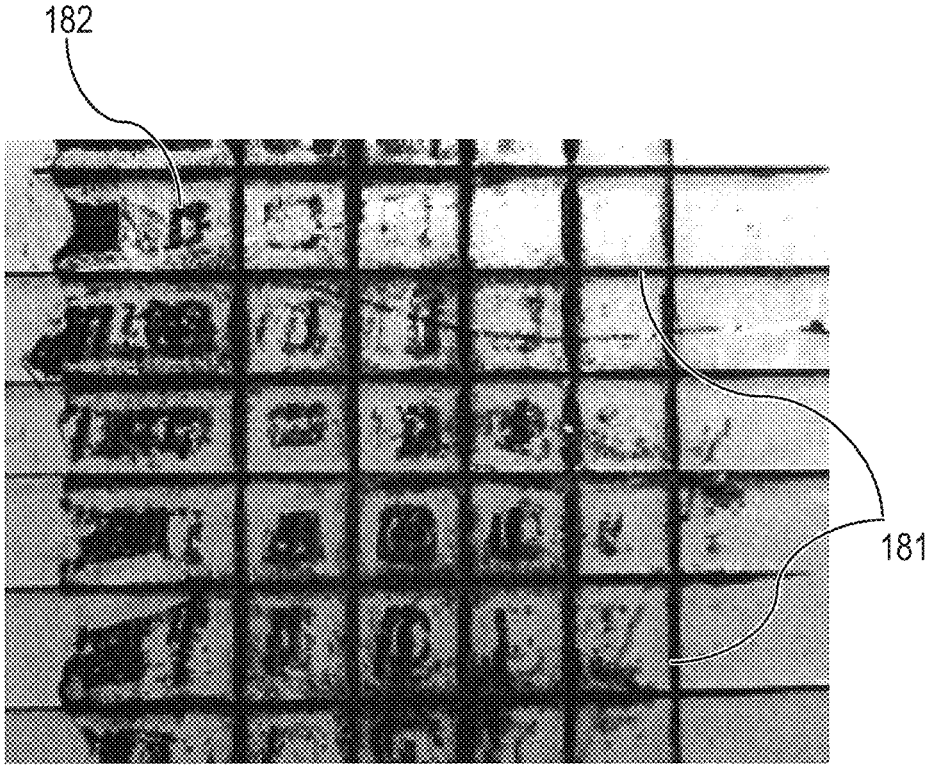
FIG. 2A is an electron micrograph showing a result of an adhesion test in a comparative example.
Figure 2B:
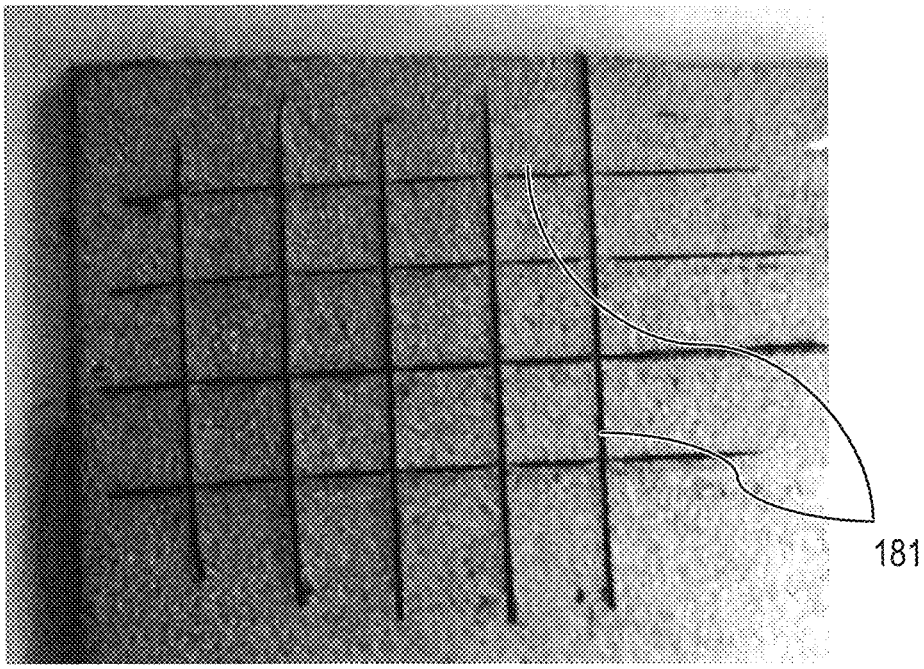
FIG. 2B is an electron micrograph showing a result of an adhesion test in an embodiment.

After corona discharge exposure, a copper plating layer was formed on the surface of the substrate by electroless plating. Next, cuts were made in a grid pattern in the copper plating layer. The cuts penetrated the copper plating layer and reached the substrate. Next, an adhesive tape was attached to the copper plating layer and then was peeled off. A state of the copper plating layer at that time is shown in FIG. 2B. In FIG. 2B, a reference numeral 181 represents the cuts. The copper plating layer did not peel off in any grid. That is, adhesion between the copper plating layer and the substrate was high.

A test of a comparative example was performed basically in the same manner. In the comparative example, surface roughening treatment and surface modification treatment were not performed on the substrate. The arithmetic average roughness Ra of the surface of the substrate was 0.13 μm. FIG. 2A shows a state of the copper plating layer when the adhesive tape was peeled off in the comparative example. The copper plating layer peeled off in 17 out of 20 grid squares, resulting in a portion 182 where the substrate was exposed. That is, in the comparative example, adhesion between the copper plating layer and the substrate was low.

The contact angle on the outer peripheral surface of the insulation layer is preferably 95° or less. In this case, it is easy to make the thickness of the plating layer uniform. Uniform thickness of the plating layer can suppress transmission loss of the differential signal transmission cable.

A method of reducing the contact angle on the outer peripheral surface of the insulation layer to 95° or less includes performing surface modification treatment such as, for example, electron beam irradiation, ion irradiation, corona discharge exposure, plasma exposure, ultraviolet irradiation, X-ray irradiation, γ-ray irradiation, immersion in ozone-containing liquid or the like.

In any of these treatments, the higher the intensity of treatment is, the smaller the contact angle can be made. Also, the longer the treatment time is, the smaller the contact angle can be made. Examples of methods for enhancing a surface modification effect by corona discharge exposure include increasing voltage, increasing oxygen concentration in an atmosphere of corona discharge exposure, and the like. The contact angle may be measured by dropping a water droplet having a diameter of 1.5 mm onto the outer peripheral surface of the insulating layer to read the contact angle. The contact angle may be a value at the time before the plating layer is formed.

It is preferable that an absolute value of adhesion wetting surface free energy in the outer peripheral surface of the insulation layer is 66 mJ/m$^2$ or more. In this case, it is easy to make the thickness of the plating layer uniform. Uniform thickness of the plating layer can suppress transmission loss of the differential signal transmission cable.

A method for making the absolute value of adhesion wetting surface free energy in the outer peripheral surface of the insulation layer to be 66 mJ/m$^2$ or more includes, for example, electron beam irradiation, ion irradiation, corona discharge exposure, plasma exposure, ultraviolet irradiation, X-ray irradiation, γ-ray irradiation, immersion in ozone-containing liquid, and the like.

In any of these treatments, the higher the intensity of treatment is, the larger the absolute value of adhesion wetting surface free energy can be made. Also, the longer the treatment time is, the larger the absolute value of adhesion wetting surface free energy can be made.

The absolute value of adhesion wetting surface free energy ΔG is calculated by Formula 3 below.

$$|\Delta G| = |-\gamma_{LG}(\cos\theta_c + 1)| \quad \text{[Formula 3]}$$

In Formula 3, $\gamma_{LG}$ is a constant, which is 72.75 mJ/m$^2$. $\theta_c$ is the contact angle on the outer peripheral surface of the insulation layer. The adhesion wetting surface free energy ΔG is a value at the time before the plating layer is formed.

The following test confirmed that a plating layer can be uniformly formed in the case where the contact angle in the outer peripheral surface of the insulation layer is 95° or less, or the absolute value of adhesion wetting surface free energy is 66 mJ/m$^2$ or more.

Figure 3A:
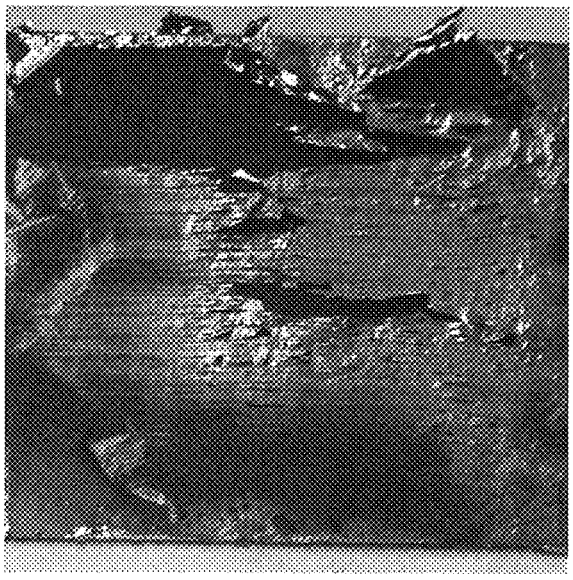
FIG. 3A is an electron micrograph showing a surface condition of a copper plating layer formed in a first comparative example.
Figure 3B:
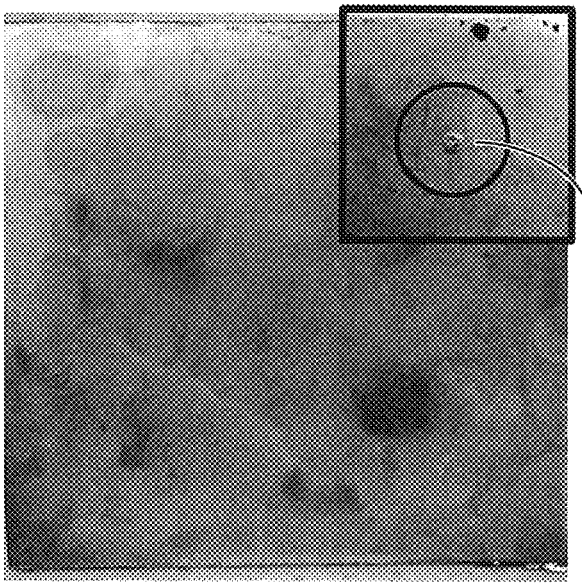
FIG. 3B shows a surface condition of a copper plating layer formed in a second comparative example.
Figure 3C:
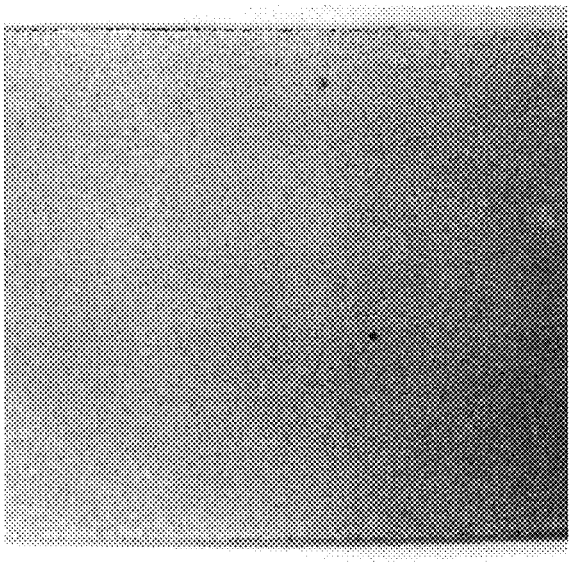
FIG. 3C is an electron micrograph showing a surface condition of a copper plating layer formed after dry ice blasting and corona discharge exposure.

A substrate made of polyethylene was prepared. This substrate corresponds to the insulation layer. The substrate was subjected to dry ice blasting, and then to corona discharge exposure. Dry ice blasting corresponds to surface roughening treatment. Corona discharge exposure corresponds to surface modification treatment. The arithmetic average roughness Ra of the surface of the substrate after corona discharge exposure was 0.6 μm or more. The absolute value of adhesion wetting surface free energy of the surface of the substrate after corona discharge exposure was 66 mJ/m$^2$ or more, and the contact angle was 95° or less. Next, a copper plating layer was formed on the surface of the substrate by electroplating. A thickness of the copper plating layer was three times larger than the thickness of the copper plating layer formed in the first test. The copper plating layer formed is shown in FIG. 3C. The copper plating layer was uniformly formed. In addition, adhesion between the copper plating layer and the substrate was high, and the copper plating layer did not peel off.

A first comparative example was prepared basically in the same manner. However, in the first comparative example, the arithmetic average roughness Ra of the surface of the substrate after surface roughening treatment was less than 0.6 μm. The absolute value of adhesion wetting surface free energy of the surface of the substrate after surface modification treatment was 66 mJ/m$^2$ or more, and the contact angle was 95° or less. The copper plating layer formed in the first comparative example is shown in FIG. 3A. The copper plating layer remarkably peeled off.

A second comparative example was prepared basically in the same manner. However, in the second comparative example, the arithmetic average roughness Ra of the surface of the substrate after surface roughening treatment was 0.6 μm or more. The absolute value of adhesion wetting surface free energy of the surface of the substrate after surface modification treatment was less than 66 mJ/m$^2$, and the contact angle was greater than 95°. The copper plating layer formed in the second comparative example is shown in FIG. 3B. Plating defect of swelling 191 called blister was present on the surface of the copper plating layer, resulting in a non-uniform plating state.

The arithmetic average roughness Ra on the outer peripheral surface of the insulation layer and the absolute value of the contact angle or the adhesion wetting surface free energy can be controlled by performing dry ice blasting on the outer peripheral surface of the insulation layer and then performing surface modification treatment in which corona discharge exposure is performed (hereinafter referred to as a specific surface modification treatment). This was confirmed by the following test. Dry ice blasting corresponds to surface roughening treatment. Corona discharge exposure corresponds to surface modification treatment.

Figure 4:
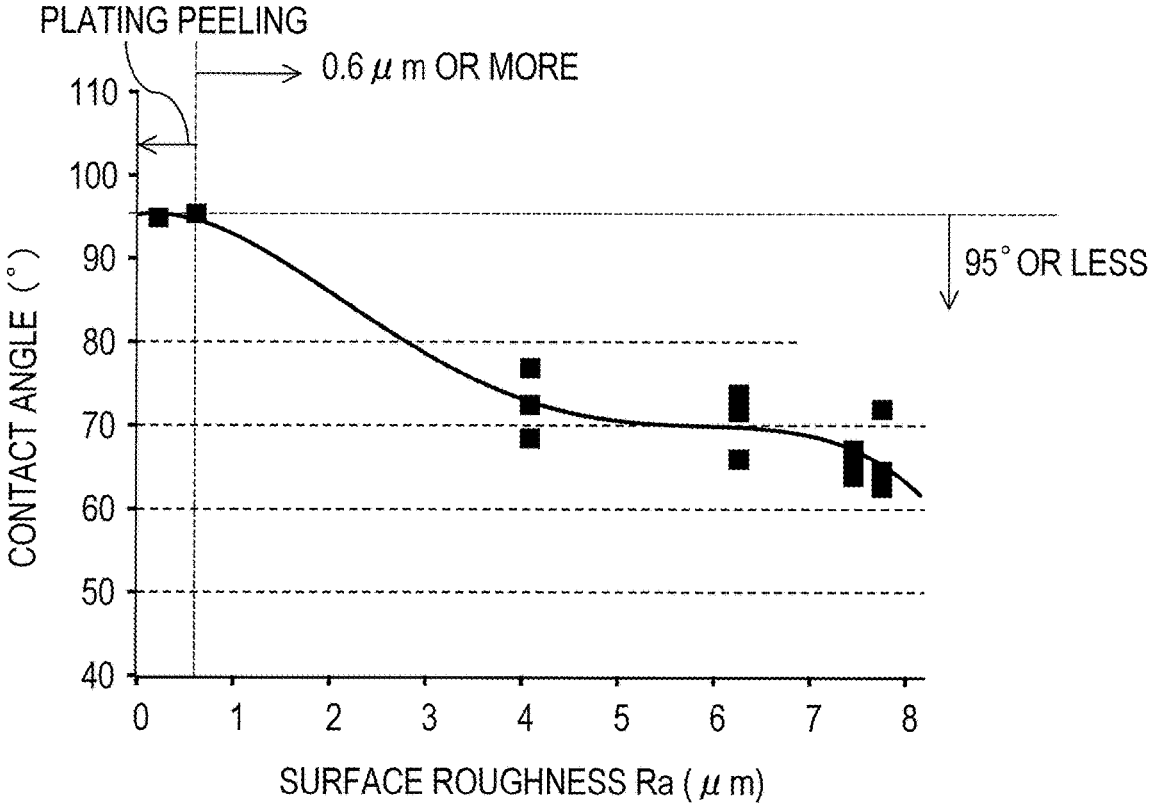
FIG. 4 is a graph showing a correlation between arithmetic average roughness Ra of a polyethylene substrate and contact angle after a specific surface modification treatment.

The specific surface modification treatment was performed on a substrate containing polyethylene. The substrate corresponds to the insulation layer. There are a plurality of conditions for the specific surface modification treatment. FIG. 4 shows a correlation between the arithmetic average roughness Ra after the specific surface modification treatment and the contact angle. The arithmetic average roughness Ra can be 0.6 μm or more and the contact angle can be 95° or less by performing the specific surface modification treatment.

Figure 5:
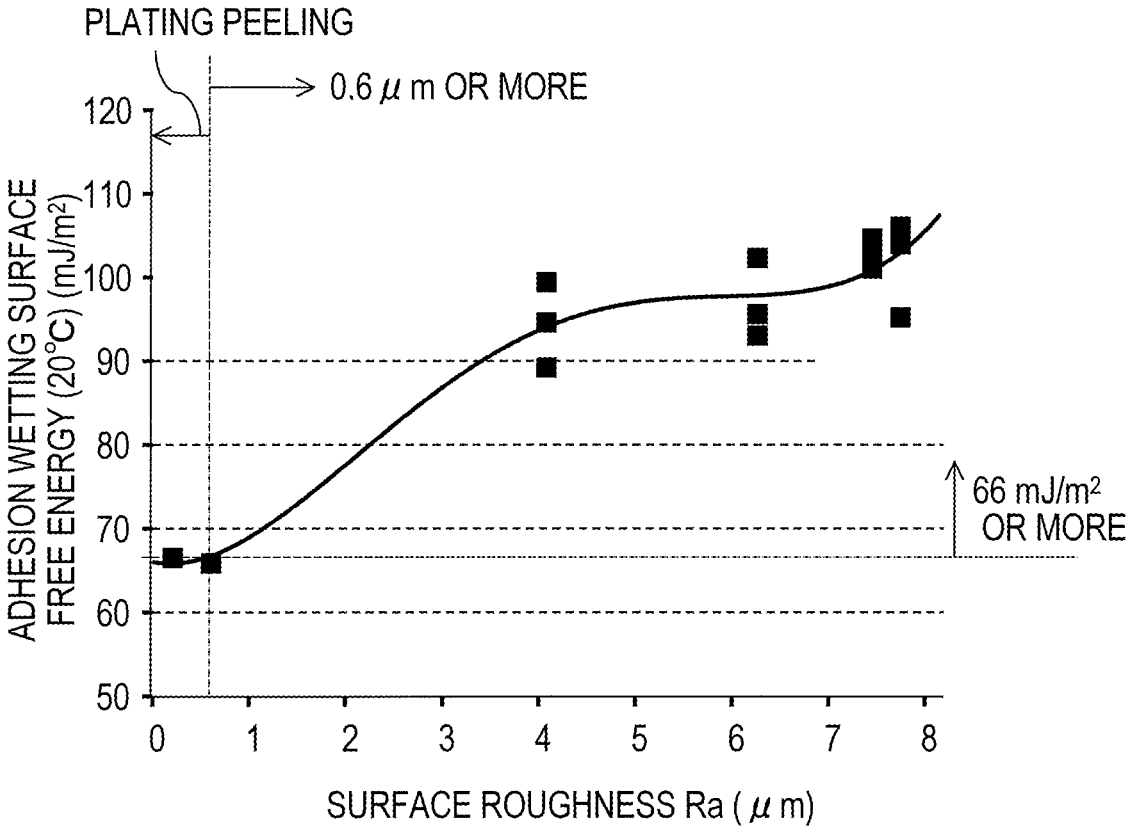
FIG. 5 is a graph showing a correlation between arithmetic average roughness Ra of a polyethylene substrate and adhesion wetting surface free energy after a specific surface modification treatment.

FIG. 5 shows a correlation between the arithmetic average roughness Ra after the specific surface modification treatment and the adhesion wetting surface free energy. The arithmetic average roughness Ra can be 0.6 μm or more and the absolute value of adhesion wetting surface free energy can be 66 mJ/m$^2$ or more by performing the specific surface modification treatment.

It is preferable that the insulation layer has a recess on its outer peripheral surface. In this case, it is difficult for the insulation layer and the plating layer to separate from each other. It is preferable that the recess has a portion which is wider than an opening in the recess at its inner part in a depth direction. In this case, the "anchor effect" occurs. When the plating layer is formed, a plating bath solution enters the inner part of the recess. Nucleation occurs at the inner part of the recess, and the plating layer grows even at the inner part of the recess. Since the plating layer grown on the inner part of the recess is larger than the opening, it is difficult to escape from the opening (and acts as a physical anchor for the plating). As a result, an anchor effect occurs, and the plating layer and the insulation layer are less likely to separate.

Figure 6:
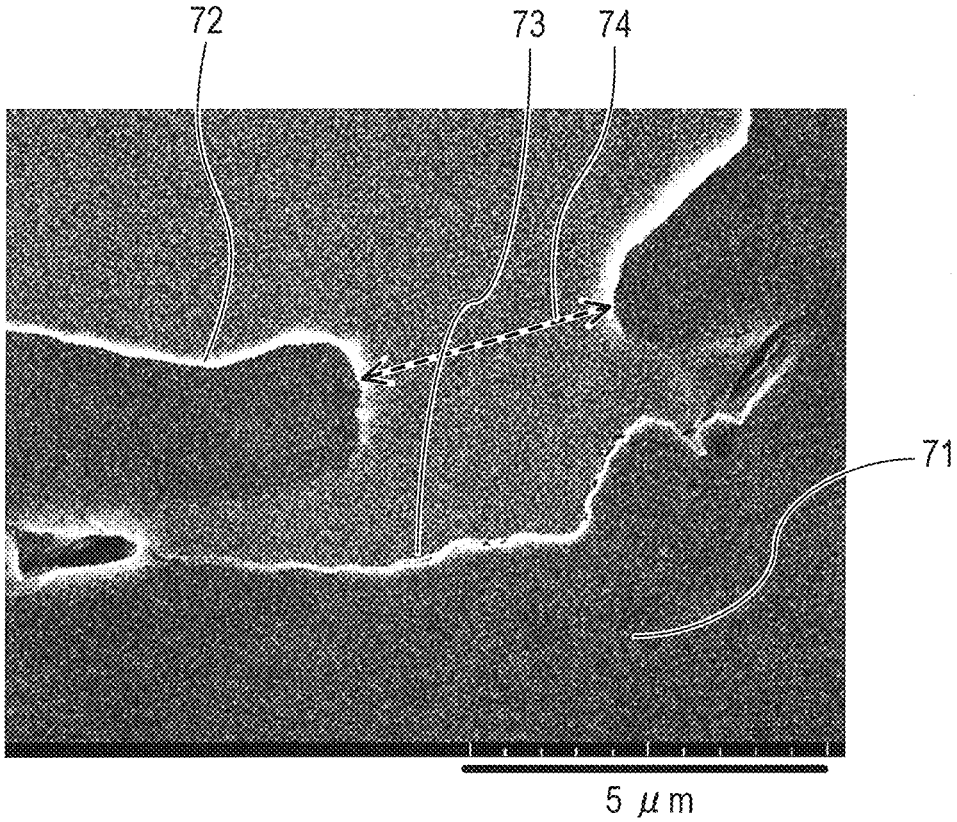
FIG. 6 is an electron micrograph showing a recess formed on an outer peripheral surface of an insulation layer by dry ice blasting.

A method of forming a recess in the insulation layer comprises blasting. Blasting comprises, for example, dry ice blasting. Dry ice blasting corresponds to surface roughening treatment. FIG. 6 shows an example of a recess formed in the outer peripheral surface of the insulation layer by dry ice blasting. FIG. 6 is a cross sectional view of the vicinity of an outer peripheral surface 72 of an insulation layer 71. A recess 73 is formed on the outer peripheral surface 72. The recess 73 has a portion which is wider than an opening 74 in the recess 73 on the inner side in a depth direction. The recess 73 may be in an octopus pot-like shape. In the example shown in FIG. 6, the insulation layer 71 may comprise polyethylene.

Examples of material of the insulation layer include polytetrafluoroethylene (PTFE), perfluoroalkoxy (PFA), perfluoro ethylene propene copolymer (FEP), ethylene tetrafluoroethylene copolymer (ETFE), tetrafluoroethylene-perfluorodioxole copolymer (TFE/PDD), polyvinylidene fluoride (PVDF), polychlorotrifluoroethylene (PCTFE), ethylene-chlorotrifluoroethylene copolymer (ECTFE), polyvinyl fluoride (PVF), silicone, polyethylene (PE), and the like.

The insulation layer may comprise a foamable resin. When the insulation layer comprises a foamable resin, a dielectric constant and a dielectric loss tangent of the insulation layer become small. A manufacturing method of an insulation layer comprising a foamable resin includes, for example, kneading a resin and a foaming agent, and foaming the kneaded material by controlling the temperature and pressure upon molding the insulation layer. Another method of manufacturing an insulation layer comprising a foamable resin includes, for example, injecting nitrogen gas or the like upon high-pressure molding the insulation layer, and then foaming the insulation layer under reduced pressure.

Further, an insulation layer comprising a foamable resin may be produced as follows. An extrusion die of a desired shape is placed in an extruder. Using the extruder, two signal lines and a foamable resin are simultaneously extruded. The foamable resin forms an insulation layer.

For example, an insulation layer comprising polyethylene and having a crystallinity Xc represented by Formula 1 (below) of 0.744 or more is preferred. In this case, it is easy to make the thickness of the plating layer uniform. Uniform thickness of the plating layer can suppress transmission loss of the differential signal transmission cable.

$$X_c = \frac{I_c}{I_c + I_a} \quad \text{[Formula 1]}$$

In Formula 1, Ic is X-ray diffraction intensity of a crystalline component, and Ia is X-ray diffraction intensity of an amorphous component.

The method for setting the crystallinity Xc of a polyethylene-containing insulation layer to 0.744 or more includes performing surface modification treatment such as, for example, electron beam irradiation, ion irradiation, corona discharge exposure, plasma exposure, ultraviolet irradiation, X ray irradiation, γ-ray irradiation, immersion in ozone-containing liquid, and the like. In any of the treatments, the larger the intensity of treatment is, the larger the crystallinity Xc can be made. Further, the longer the treatment time is, the larger the crystallinity Xc can be made.

Figure 7:
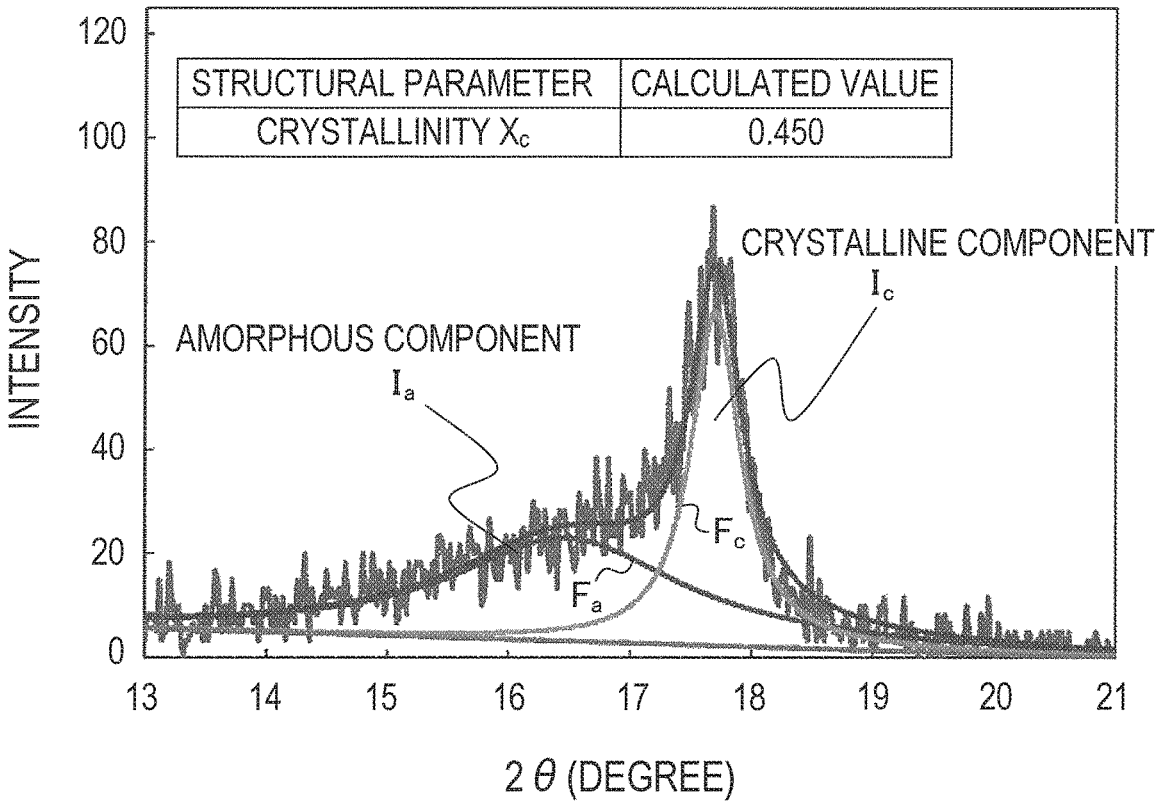
FIG. 7 is an X-ray diffraction pattern of a sample of the insulation layer.
Figure 8:
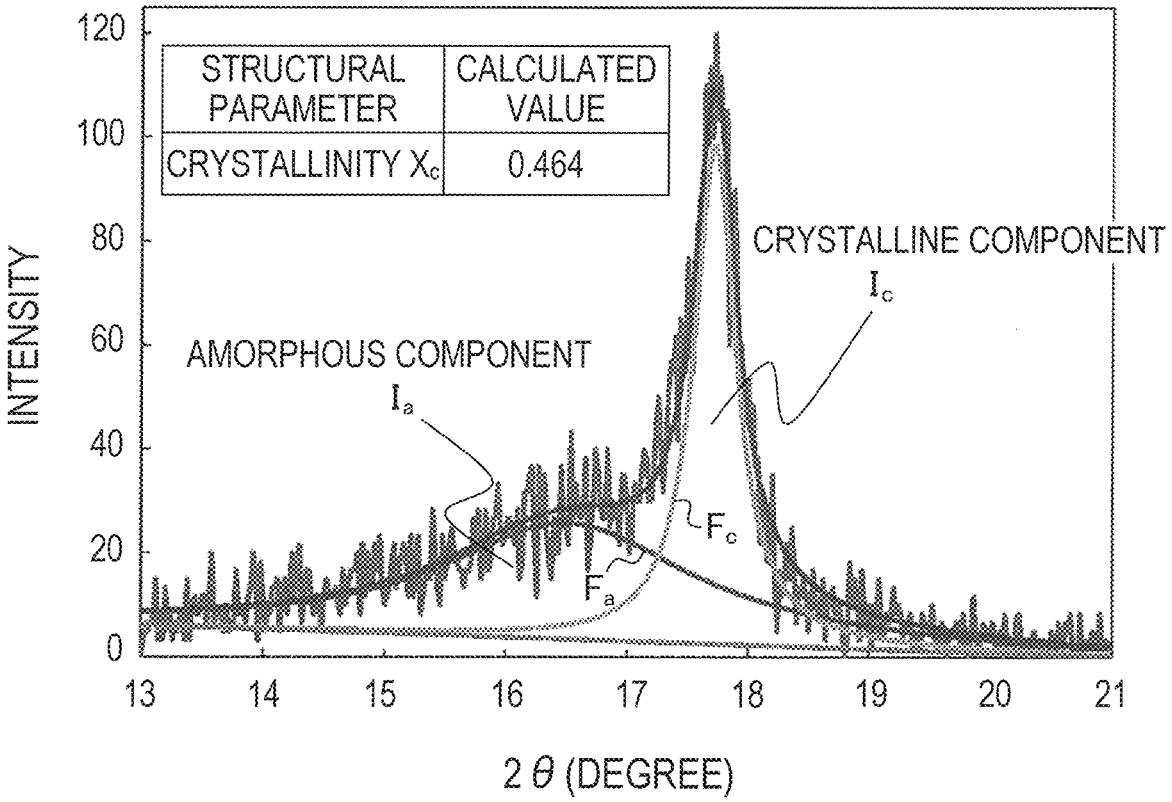
FIG. 8 is an X-ray diffraction pattern of a sample of the insulation layer.

Ic and Ia in Formula 1 are calculated as follows. An X-ray diffraction pattern of a sample insulation layer is acquired using RINT2500 which is an X-ray diffraction apparatus manufactured by Rigaku Corporation. Examples of the X-ray diffraction pattern are shown in FIGS. 7 and 8. A horizontal axis of the X-ray diffraction pattern shown in FIGS. 7 and 8 is a diffraction angle 2θ. A range of the diffraction angle 2θ in the X-ray diffraction pattern may be 13° to 21°.

In the X-ray diffraction pattern, a broad halo (hereinafter referred to as amorphous halo) having a diffraction peak at around 16.4° to 16.5° corresponds to the amorphous component. In the X-ray diffraction pattern, a sharp spectrum (hereinafter referred to as crystalline component spectrum) having a peak at 17.7° corresponds to the crystalline component.

Spectrum fitting analysis using Lorentzian function is performed to the amorphous halo, so as to acquire a smooth curve Fa, which well matches the amorphous halo. The acquired curve Fa is shown in FIGS. 7 and 8. Intensity of the amorphous halo calculated by integral intensity calculation based on this curve Fa is Ia.

Further, spectrum fitting analysis using Lorentzian function is performed to the crystalline component spectrum, so as to acquire a smooth curve Fc, which well matches the crystalline component spectrum. The acquired curve Fc is shown in FIGS. 7 and 8. Intensity of the amorphous component spectrum calculated by integrated intensity calculation based on this curve Fc is Ic. The crystallinity Xc is a value at the time before the plating layer is formed.

It is preferable that the insulation layer comprises, for example, perfluoro ethylene propene copolymer, and has a crystallinity Xc represented by Formula 1 below of 0.47 or less. In this case, it becomes easy to make the thickness of the plating layer uniform. Uniform thickness of the plating layer can suppress transmission loss of the differential signal transmission cable.

$$X_c = \frac{I_c}{I_c + I_a} \quad \text{[Formula 1]}$$

In Formula 1, Ic is an X-ray diffraction intensity of a crystalline component, Ia is an X-ray diffraction intensity of an amorphous component. The calculation method of Ic and Ia may be the method described above. The crystallinity Xc may be a value at the time before the plating layer is formed.

A method of making the crystallinity Xc of the insulation layer containing perfluoro ethylene propene copolymer to 0.47 or less includes performing surface modification treatment such as, for example, electron beam irradiation, ion irradiation, corona discharge exposure, plasma exposure, ultraviolet irradiation, X-ray irradiation, γ-ray irradiation, immersion in ozone-containing liquid, and the like. In any of the treatments, the larger the intensity of treatment is, the larger the crystallinity Xc can be made. Also, the longer the treatment time is, the larger the crystallinity Xc can be made.

Figure 9A:
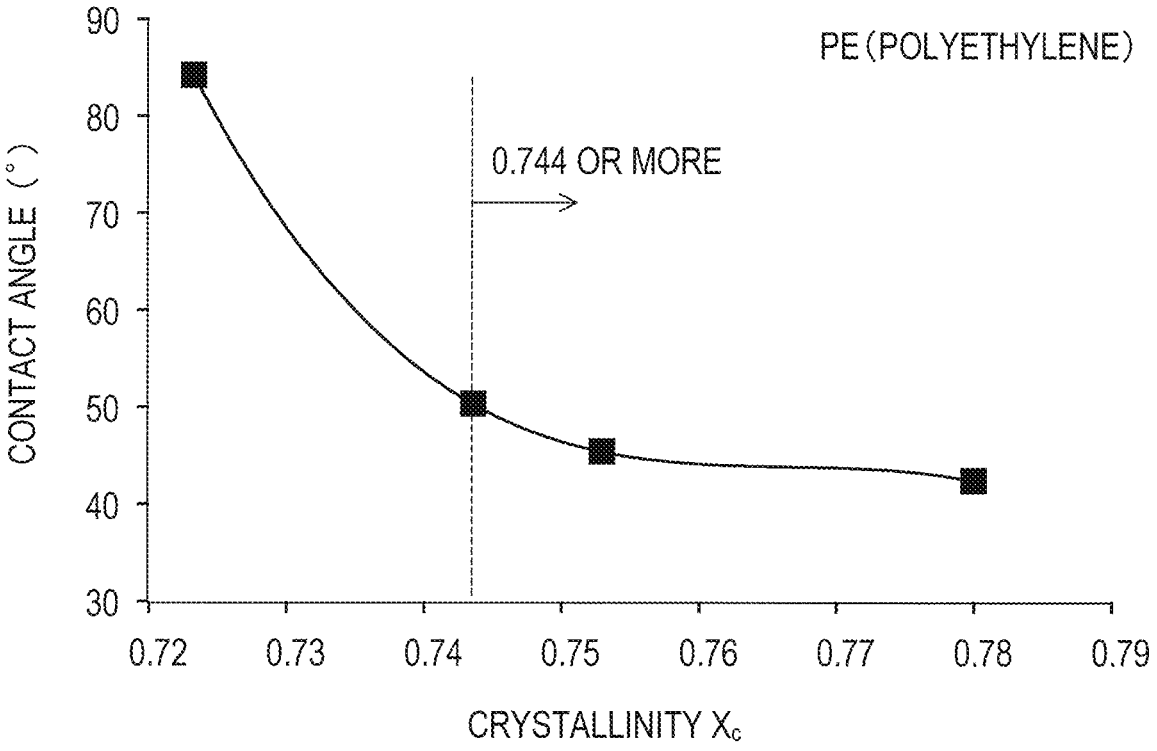
FIG. 9A is a graph showing a correlation between crystallinity Xc of a polyethylene substrate and contact angle after a specific surface modification treatment.

The crystallinity Xc is correlated with the contact angle. This was confirmed by the following test. A substrate comprising polyethylene was subjected to the specific surface modification treatment. The substrate corresponds to the insulating layer. There are a plurality of conditions for the specific surface modification treatment. A correlation between the contact angle and the crystallinity Xc after the specific surface modification treatment is shown in FIG. 9A. When the crystallinity Xc is 0.744 or more, the contact angle becomes significantly small.

Figure 9B:
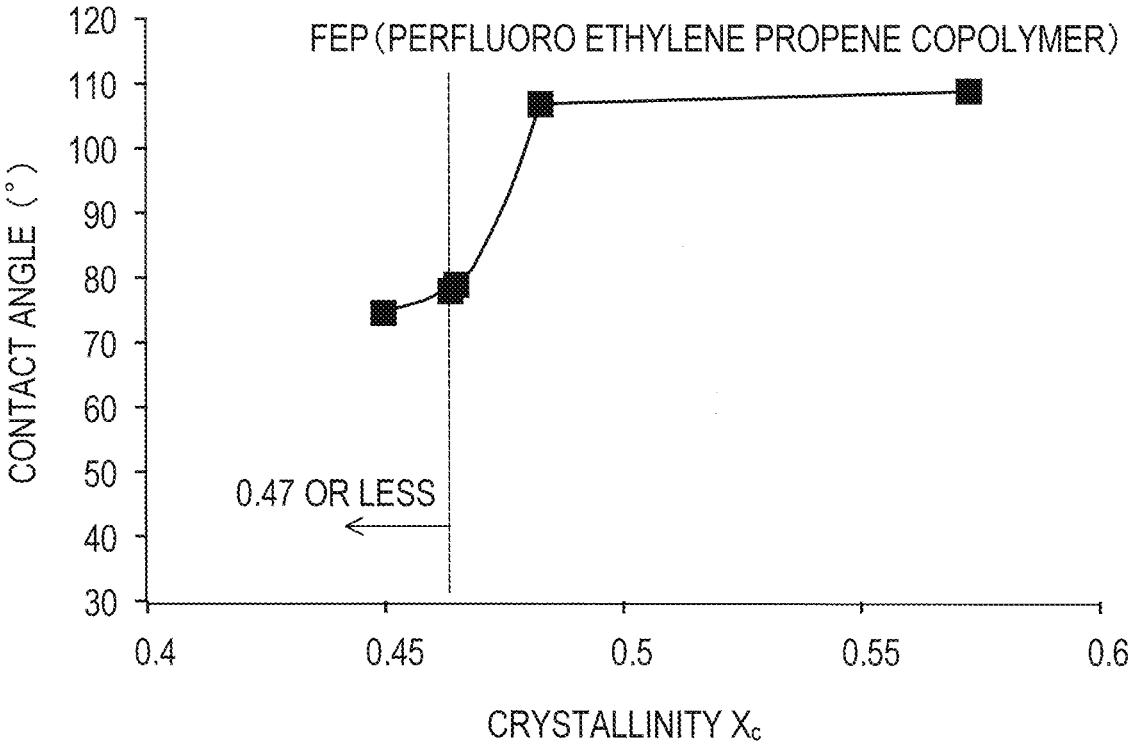
FIG. 9B is a graph showing a correlation between crystallinity Xc of perfluoro ethylene propene copolymer substrate and contact angle after a specific surface modification treatment.

Further, a substrate comprising perfluoro ethylene propene copolymer was subjected to the specific surface modification treatment. The substrate corresponds to the insulating layer. There are a plurality of conditions for the specific surface modification treatment. A correlation between the contact angle and the crystallinity Xc after the specific surface modification treatment is shown in FIG. 9B. When the crystallinity Xc is 0.47 or less, the contact angle becomes significantly small.

For example, the following insulation layer is preferred. The insulation layer comprises polyethylene. The polyethylene has a triclinic crystal structure, an orthorhombic crystal structure, or a state in which at least one of the structures coexists, and is preferentially oriented to a specific axis not more than two axes among crystal axes. Moreover, the polyethylene has a (100) crystal orientation degree $O_{100}$ represented by Formula 2 below of 0.26 or less. This insulation layer is a specifically oriented polyethylene insulation layer below.

$$O_{100} = \frac{I_{200}}{I_{110} + I_{200}} \quad \text{[Formula 2]}$$

In Formula 2, I200 is an X-ray diffraction intensity at index 200, and I110 is an X-ray diffraction intensity at index 110.

When the insulating layer is the specifically oriented polyethylene insulation layer, it becomes easy to uniform the thickness of the plating layer. Uniform thickness of the plating layer can suppress transmission loss of the differential signal transmission cable.

A method for making an insulating layer a specifically oriented polyethylene insulation layer includes performing surface modification treatment such as, for example, electron beam irradiation, ion irradiation, corona discharge exposure, plasma exposure, ultraviolet irradiation, X-ray irradiation, γ-ray irradiation, immersion in ozone-containing liquid, and the like.

In any of the treatments, the larger the intensity of treatment is, the smaller the crystal orientation degree $O_{100}$ can be made. Also, the longer the treatment time is, the smaller the crystal orientation degree $O_{100}$ can be made.

In Formula 2, I200 and I110 are calculated as follows.

Figure 10:
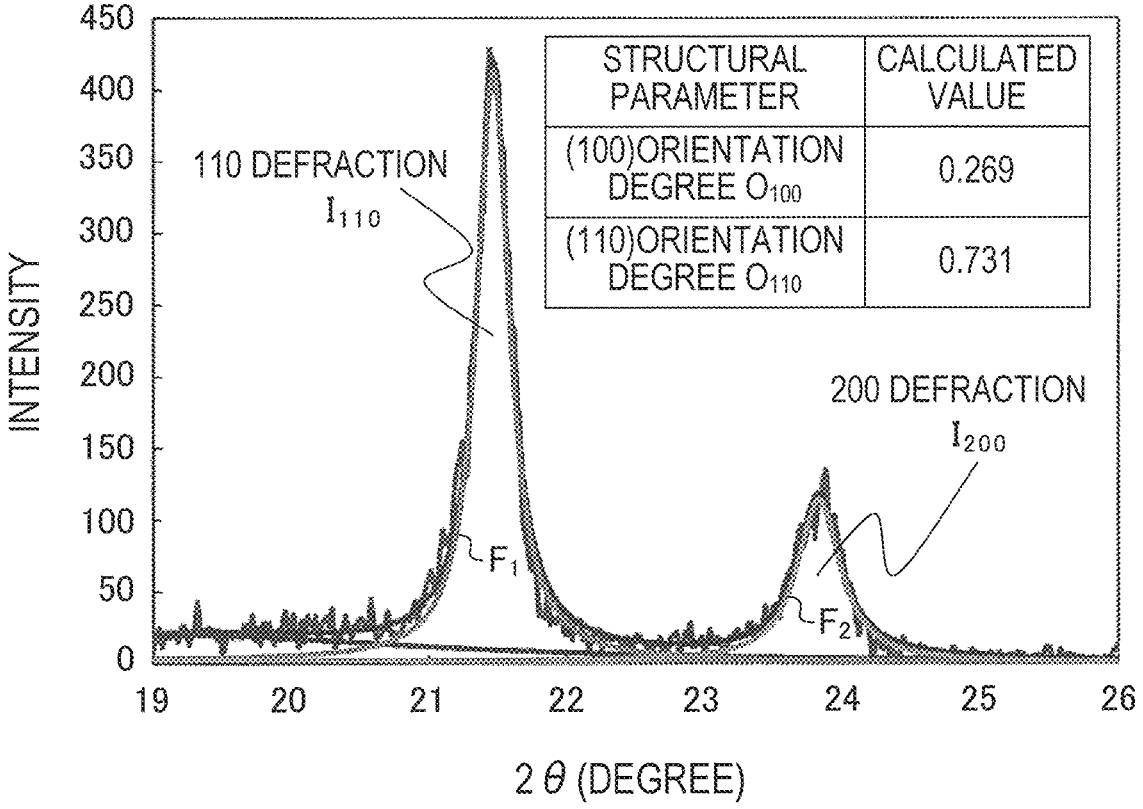
FIG. 10 is an X-ray diffraction pattern of a sample of the insulation layer.
Figure 11:
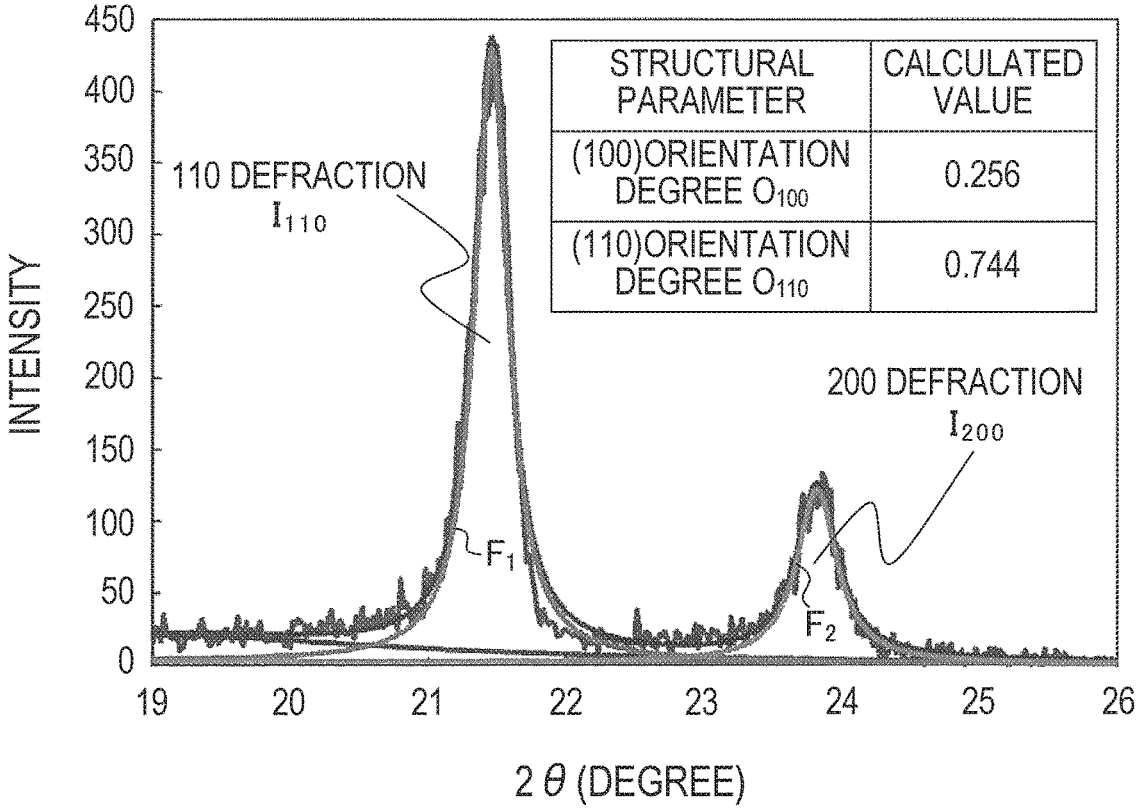
FIG. 11 is an X-ray diffraction pattern of a sample of the insulation layer.

Using an X-ray diffraction apparatus RINT2500 manufactured by Rigaku Corporation, an X-ray diffraction pattern of a sample insulation layer is acquired. Examples of the X-ray diffraction pattern are shown in FIGS. 10 and 11. A horizontal axis of the X-ray diffraction pattern shown in FIG. 11 is a diffraction angle 2θ. A range of the diffraction angle 2θ in the X-ray diffraction pattern may be 19° to 26°. FIGS. 10 and 11 show an X-ray diffraction pattern of the sample insulating layer comprising polyethylene having an orthorhombic crystal structure. FIG. 10 shows an X-ray diffraction pattern of polyethylene not subjected to surface modification treatment. FIG. 11 shows an X-ray diffraction pattern of polyethylene subjected to corona discharge exposure as surface modification treatment.

The diffraction spectrum having its peak around 21.5° (hereinafter referred to as the 110 diffraction spectrum) corresponds to Miller index 110, and represents an orientation of a (110) lattice plane. The diffraction spectrum having its peak around 23.8° (hereinafter referred to as 200 diffraction spectrum) corresponds to Miller index 200, and represents a (100) lattice plane.

Spectrum fitting analysis using Lorentzian function is performed to the 110 diffraction spectrum, so as to acquire a smooth curve F1 that well matches the 110 diffraction spectrum. The acquired curve F1 is shown in FIGS. 10 and 11. Intensity of the 110 diffraction spectrum calculated by integrated intensity calculation is based on this curve F1 is I110.

Further, spectrum fitting analysis using Lorentzian function is performed to the 200 diffraction spectrum, so as to acquire a smooth curve F2 that well matches the 200 diffraction spectrum. The acquired curve F2 is shown in FIGS. 10 and 11. Intensity of the 200 diffraction spectrum calculated by integrated intensity calculation based on this curve F2 is I200.

When individual crystal grains contained in the material comprising a polycrystalline material are preferentially oriented to a certain direction, X-ray diffraction intensity of a particular index plane becomes relatively higher than other X-ray diffraction intensity. Therefore, orientation of a given lattice plane can be quantified by an intensity ratio of X-ray diffraction intensity. A (100) crystal orientation degree $O_{100}$ is an intensity ratio of X-ray diffraction intensity, and represents a preferred orientation of the (100) plane.

Figure 12:
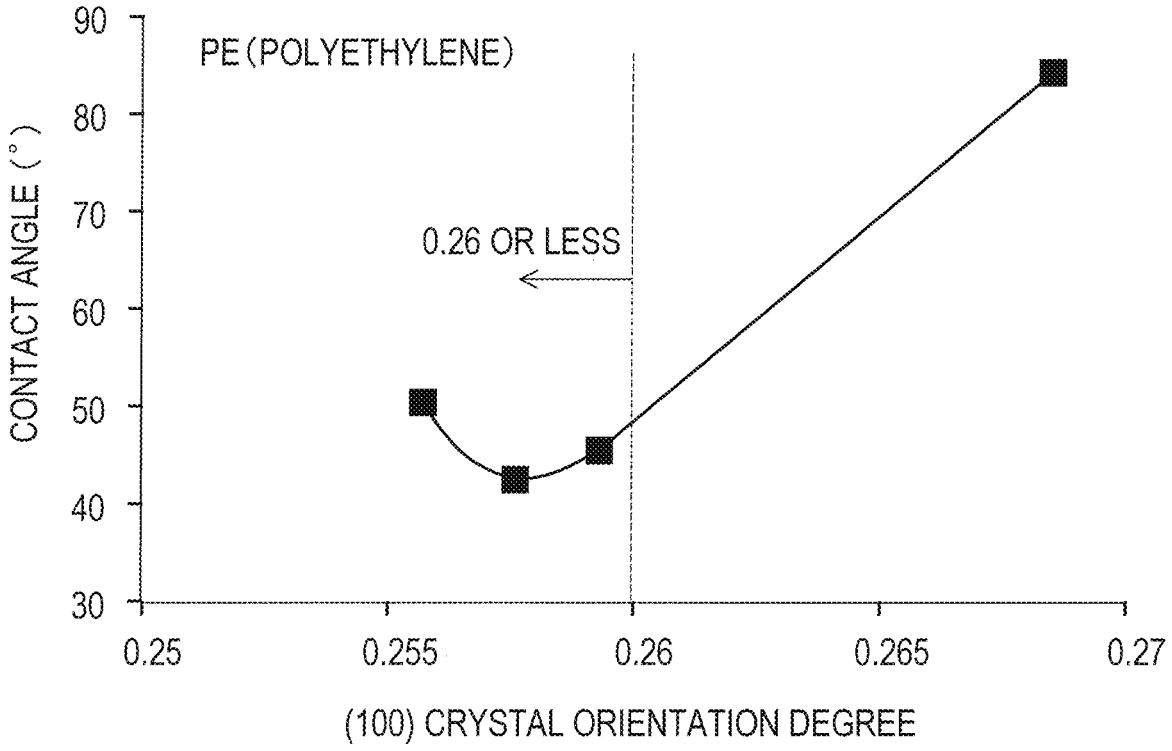
FIG. 12 is a graph showing a correlation between (100) crystal orientation degree $O_{100}$ and contact angle after a specific surface modification treatment.

The (100) crystal orientation degree $O_{100}$ is correlated with the contact angle. This was confirmed by the following test. A substrate comprising polyethylene was subjected to the specific surface modification treatment. The substrate corresponds to the insulating layer. There are a plurality of conditions for the specific surface modification treatment. A correlation between the (100) crystal orientation degree $O_{100}$ and the contact angle after the specific surface modification treatment is shown in FIG. 12. When the (100) crystal orientation degree $O_{100}$ is 0.26 or less, the contact angle became significantly small. The (100) crystal orientation degree $O_{100}$ is a value at the time before the plating layer is formed.

For example, the following insulating layer is preferred. The insulation layer comprises polyethylene. Crystallite size in the crystalline component of the polyethylene may be 18 nm or more. When the insulation layer has the above configuration, it becomes easy to make the thickness of the plating layer uniform. Uniform thickness of the plating layer can suppress transmission loss of the differential signal transmission cable.

A method of forming an insulation layer having a structure described above includes performing surface modification treatment such as, for example, electron beam irradiation, ion irradiation, corona discharge exposure, plasma exposure, ultraviolet irradiation, X-ray irradiation, γ-ray irradiation, immersion in ozone-containing liquid, and the like.

In any of the treatments, the higher the intensity of treatment is, the larger the crystallite size in the crystalline component of polyethylene can be made. Further, the longer the treatment time is, the larger the crystallite size in the crystalline component of polyethylene can be made.

The crystallite size in the crystalline component of polyethylene is represented by Formula 4 below.

$$D = \frac{K\lambda}{B\cos\theta_d} \quad \text{[Formula 4]}$$

In Formula 4, D is the crystallite size in the crystalline component of the polyethylene. K is the Scherrer constant. The value of K was 2/π. λ is the X-ray wavelength. B is a distribution width of the X-ray diffraction peak. The distribution width refers to a full width at half maximum. $\theta_d$ is the X-ray diffraction angle. λ, B, and $\theta_d$ are values acquired from the X-ray diffraction pattern of the sample insulation layer. The crystallite size is a value at the time before the plating layer is formed.

Figure 13A:
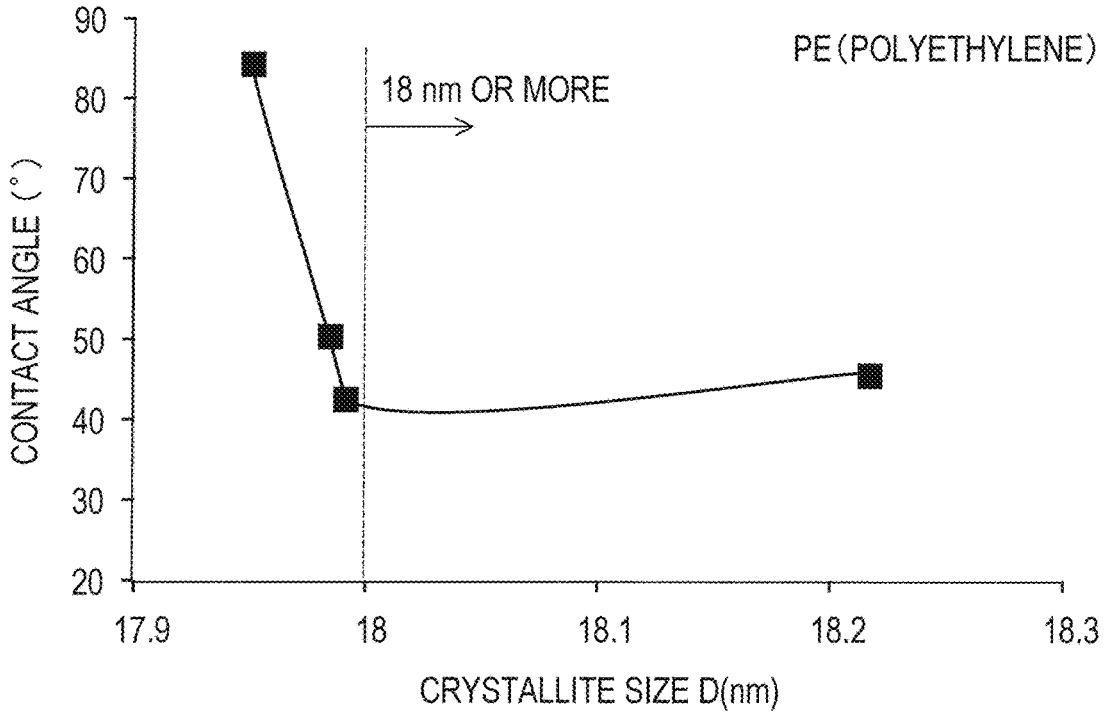
FIG. 13A is a graph showing a correlation between crystallite size D in a crystalline component of polyethylene and contact angle after a specific surface modification treatment.

The crystallite size D in the crystalline component of polyethylene is correlated with the contact angle. This was confirmed by the following test. A substrate containing polyethylene was subjected to the specific surface modification treatment. The substrate corresponds to the insulation layer. There are a plurality of conditions for the specific surface modification treatment. FIG. 13A shows a correlation between the crystallite size D and the contact angle in the crystalline component of polyethylene after the specific surface modification treatment. When the crystallite size D of the crystalline component of polyethylene is 18 nm or more, the contact angle becomes significantly small.

For example, the following insulation layer is preferable. The insulation layer comprises perfluoro ethylene propene copolymer. The crystallite size of the crystalline component of the perfluoro ethylene propene copolymer may be 13.6 nm or less. When the insulation layer has the above structure, it is easy to make the thickness of the plating layer uniform. Uniform thickness of the plating layer can suppress transmission loss of the differential signal transmission cable.

Examples of a method for forming the insulation layer having the above structure include performing surface modification treatment such as electron beam irradiation, ion irradiation, corona discharge exposure, plasma exposure, ultraviolet irradiation, X-ray irradiation, γ-ray irradiation, immersion in ozone-containing liquid and the like.

In any of the treatments, the larger the intensity of treatment is, the larger the crystallite size in the crystalline component of the perfluoro ethylene propene copolymer can be made. Also, the longer the treatment time is, the larger the crystallite size in the crystalline component of the perfluoro ethylene propene copolymer can be made. The method for calculating the crystallite size in the crystalline component of the perfluoro ethylene propene copolymer is the same as the method for calculating the crystallite size in the crystalline component of polyethylene. The crystallite size is a value at the time before the plating layer is formed.

Figure 13B:
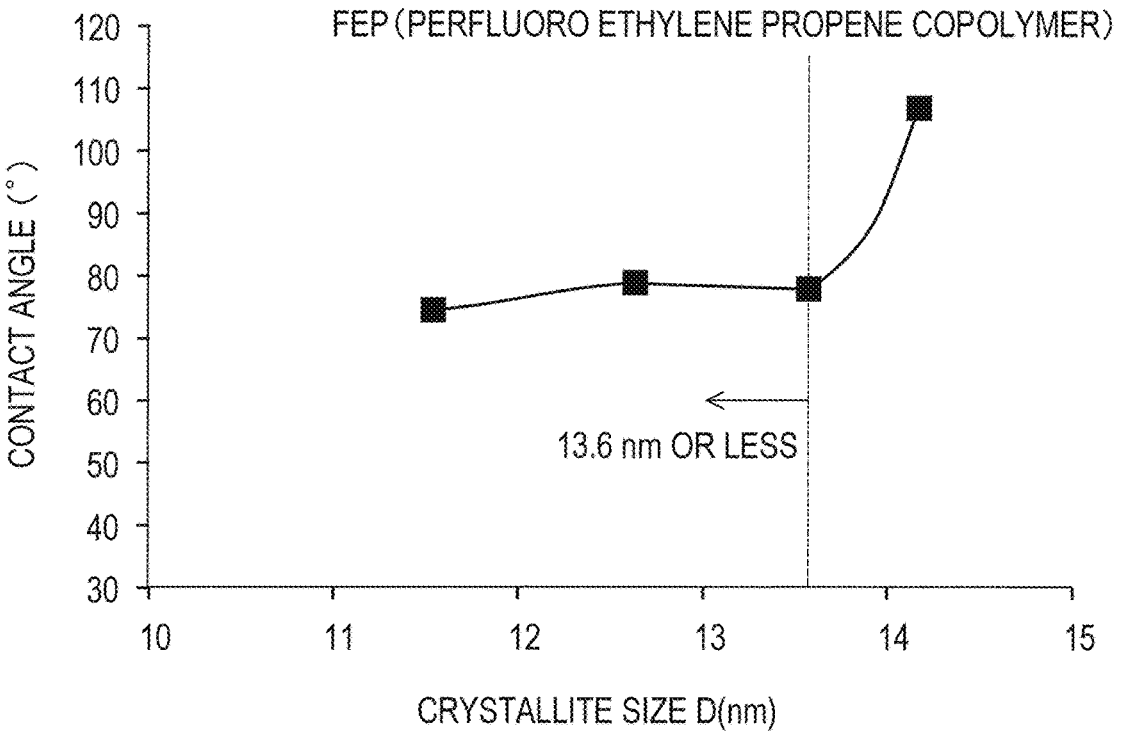
FIG. 13B is a graph showing a correlation between crystallite size D in a crystalline component of perfluoro ethylene propene copolymer and contact angle.

The crystallite size D in the crystalline component of the perfluoro ethylene propene copolymer is correlated with the contact angle. This was confirmed by the following test. The substrate containing the perfluoro ethylene propene copolymer was subjected to the specific surface modification treatment. The substrate corresponds to the insulation layer. There are a plurality of conditions for the specific surface modification treatment. The correlation between the crystallite size D and the contact angle in the crystalline component of the perfluoro ethylene propene copolymer after the specific surface modification treatment is shown in FIG. 13B. When the crystallite size D of the crystalline component of the perfluoro ethylene propene copolymer was 13.6 nm or less, the contact angle became substantially small.

(1-3) Plating Layer

The plating layer preferably has a thickness of 1 μm to 5 μm. When the plating layer has a thickness of 1 μm or more, internal skew can be further reduced, and an increase in differential-to-common mode conversion quantity can be further suppressed. In particular, when a signal of 25 GHz or more is transmitted, an increase in differential-to-common mode conversion quantity can be remarkably suppressed.

When the plating layer has a thickness of 5 μm or less, time required for forming a plating layer can be reduced. Further, when the plating layer has a thickness of 5 μm or less, bendability of the differential signal transmission cable can be improved. Further, when the plating layer has a thickness of 5 μm or less, the outer diameter of the differential signal transmission cable is reduced. The thickness of the plating layer can be controlled in a known manner. For example, the longer the electroplating and/or electroless plating time is, the thicker the plating layer becomes. Also, the larger the amount of current in electroplating is, the thicker the plating layer is made.

A standard deviation of the thickness of the plating layer is preferably 0.8 μm or less. In this case, transmission loss of the differential signal transmission cable can be suppressed. Moreover, since an excessively thin portion of the plating layer is hardly generated, noise can be further reduced.

The standard deviation of the thickness of the plating layer is calculated in the following manner. A cross section perpendicular to the longitudinal direction of the differential signal transmission cable is formed at four places. A distance between each cross section may be 3 m. Any four points are selected in each cross section. The thickness of the plating layer is measured at a total of 4×4 points. A standard deviation of the thickness of all the measurements of the plating layer is employed as the standard deviation of the thickness of the plating layer.

For example, the standard deviation of the thickness of the plating layer can be reduced by reducing the contact angle on the outer circumferential surface of the insulation layer, or increasing the absolute value of adhesion wetting surface energy.

By performing surface modification treatment such as, for example, electron beam irradiation, ion irradiation, corona discharge exposure, plasma exposure, ultraviolet irradiation, X-ray irradiation, γ-ray irradiation, immersion in ozone-containing liquid, and the like to the insulation layer, the contact angle on the outer peripheral surface of the layer can be reduced, and the absolute value of adhesion wetting surface energy can be increased.

The plating layer may be formed by stacking a plurality of layers. The number of stacked layers in the plating layer may be, for example, 2, 3, 4 or more. Among the plurality of layers, some of the layers can be a magnetic layer comprising ferrite, and the other of the layers can be a non-magnetic layer comprising copper or the like. In this case, the plating layer can exhibit a shielding effect against a strong magnetic field and a weak magnetic field. Also, the plating layer can exhibit a shielding effect against noise in a low frequency band of tens to hundreds MHz, and noise in a high frequency band of several tens GHz.

A plating layer can by formed, for example, by performing electroless plating first, and then performing electroplating. In this case, a plating layer can be easily formed on the insulation layer. Moreover, compared with a case of forming the entire plating layer by electroless plating, time required for forming the plating layer can be shortened.

2. Method of Manufacturing Differential Signal Transmission Cable

The differential signal transmission cable of the present disclosure can be manufactured, for example, by the following method. A manufacturing system 101 shown in FIG. 14 comprises a degreasing unit 103, a wet etching unit 105, a first activation unit 107, a second activation unit 109, an electroless plating unit 111, an electroplating unit 113, and a conveyance unit 115.

The degreasing unit 103 comprises a degreasing tank 117 and a degreasing solution 119. The degreasing solution 119 is contained in the degreasing tank 117. The degreasing solution 119 contains one or more of, for example, boric acid sodium, sodium phosphate, surfactant, and the like. Temperature of the degreasing solution 119, for example, may be 40° C. to 60° C.

The wet etching unit 105 for performing surface roughening treatment comprises an etching tank 121 and an etchant 123. The etchant 123 is contained in the etching tank 121. The etchant 123 contains one or more of, for example, chromic acid, sulfuric acid, ozone, acid, alkali, chelate, and the like. Temperature of the etchant 123, for example, may be 65° C. to 70° C.

The first activation unit 107 comprises a first activation tank 125 and a first activating solution 127. The first activating solution 127 is contained in the first activation tank 125. The first activation solution 127 contains one or more of, for example, palladium chloride, stannous chloride, concentrated hydrochloric acid, and the like. Temperature of the first activating liquid 127, for example, may be 30° C. to 40° C.

The second activation unit 109 comprises a second activation tank 129 and a second activating solution 131. The second activating solution 131 is contained in the second activation tank 129. The second activating solution 131 contains, for example, sulfuric acid or the like. Temperature of the second activating liquid 131, for example, may be 0° C. to 50° C.

The electroless plating unit 111 comprises an electroless plating bath 133 and an electroless plating solution 135. The electroless plating solution 135 is contained in an electroless plating bath 133. The electroless plating solution 135 contains, for example, copper sulfate, Rochelle salt, formaldehyde, sodium hydroxide and the like. Temperature of the electroless plating solution 135, for example, may be 20° C. to 30° C.

The electroplating unit 113 comprises an electroplating bath 137, an electroplating solution 139, two anodes 141, and a power supply unit 143. The electroplating solution 139 is contained in the electroplating bath 137. The electroplating solution 139, for example, has a composition shown in Table 1 or Table 2. Temperature of the electroplating solution 139, for example, may be 20° C. to 25° C.

TABLE 1

Composition of copper sulfate plating bath

| Plating bath composition | Chemical formula | Concentration (g/l) |
|---|---|---|
| copper sulfate | $CuSO_4 \cdot 5H_2O$ | 60-250 |
| metallic copper | Cu | 15-70 |
| sulfate | $H_2SO_4$ | 25-220 |
| chlorine ion (sodium chloride, hydrochloric acid*) | $Cl^-$ (NaCl, HCl) | 0.02-0.2 |

TABLE 2

Composition of copper cyanide plating bath

| Plating bath composition | Chemical formula | Concentration (g/l) |
|---|---|---|
| cuprous cyanide | CuCN | 20-80 |
| sodium cyanide (potassium cyanide) | NaCN (KCN) | 25-130 |
| free sodium cyanide* (free potassium cyanide) | NaCN (KCN) | 5-25 |
| potassium sodium tartrate | $KNaC_4H_4O_6 \cdot 4H_2O$ | 15-60 |
| sodium carbonate (potassium carbonate) | $Na_2CO_3$ ($K_2CO_3$) | 10-30 |
| potassium hydroxide (sodium hydroxide) | KOH (NaOH) | 10-20 |

The anodes 141 are immersed in the electroplating solution 139. The anodes 141 may be produced, for example, by rolling casting molten copper. Alternatively, the anodes 141 may be manufactured as follows. Using rough copper as an anode, and stainless or titanium as a cathode, seed plate electrolysis is performed. Pure copper plate deposited on the cathode surface is peeled off to make the anode 141. The power supply unit 143 applies a DC voltage between the anode 141 and later-described bobbins 165, 169.

The conveying unit 115 comprises a plurality of bobbins 145, 147, 149, 151, 153, 155, 157, 159, 161, 163, 165, 167, 169. In the following, these may also be referred to as a bobbin group collectively. The bobbins 165, 169 are electrically conductive. The bobbin 167 has insulating properties.

Figure 14:
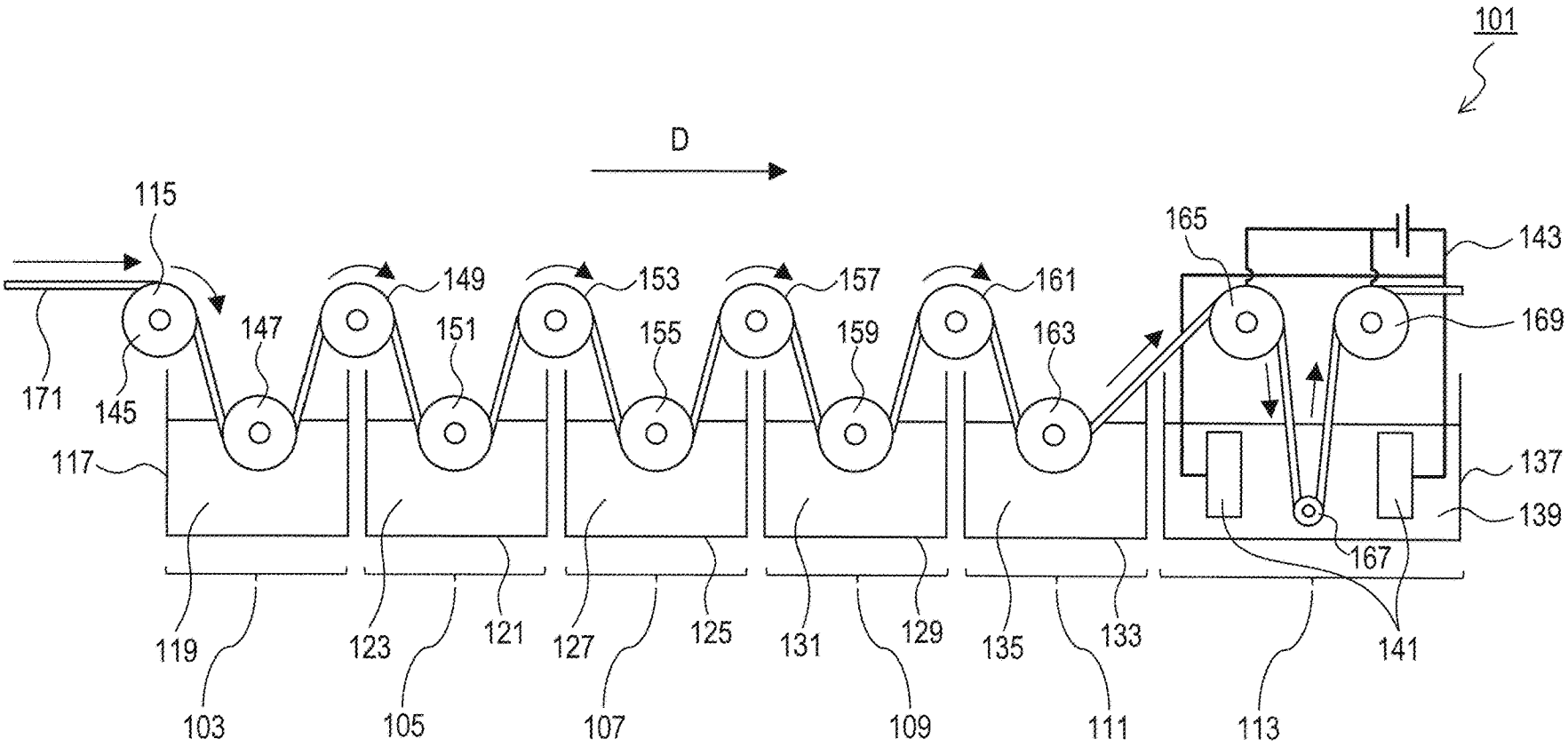
FIG. 14 is an explanatory diagram showing a configuration of a manufacturing system.

The bobbin group is basically arranged in series along a conveying direction D shown in FIG. 14. The conveying direction D may be a direction from the degreasing unit 103 towards the electroplating unit 113, sequentially through the wet etching unit 105, the first activation unit 107, the second activation unit 109, and the electroless plating unit 111.

Part of the bobbin 147 is immersed in the degreasing solution 119. Part of the bobbin 151 is immersed in the etchant 123. Part of the bobbin 155 is immersed in the first activation solution 127. Part of the bobbin 159 is immersed in the second activation solution 131. Part of the bobbin 163 is immersed in the electroless plating solution 135. The entire bobbin 167 is immersed in the electroplating solution 139.

The conveying unit 115 continuously conveys the differential signal transmission cable 171 along the conveying direction D by the bobbin group. The differential signal transmission cable 171 to be conveyed, in the initial state, is provided with the signal lines and the insulation layer, but the plating layer is not yet formed. The insulation layer, for example, may be provided by known extrusion.

The differential signal transmission cable 171 to be conveyed is first immersed for 3-5 minutes in the degreasing solution 119 in the degreasing unit 103. At this time, oil adhering to the surface of the insulation layer is removed.

Then, the differential signal transmission cable 171 is immersed in the etchant 123 in the wet etching unit 105 for 8-15 minutes. In this case, irregularities are formed on the outer peripheral surface of the insulation layer. Further, functional groups such as carbonyl groups, hydroxyl groups and the like are formed on the outer peripheral surface of the insulation layer. As a result, the outer peripheral surface of the insulation layer is hydrophilic, and surface wettability is improved.

Then, the differential signal transmission cable 171 is immersed for 1-3 minutes in the first activation solution 127 in the first activation unit 107. At this time, a catalyst layer is formed on the outer peripheral surface of the insulation layer.

Then, the differential signal transmission cable 171 is immersed in the second activation solution 131 in the second activation unit 109 for 3-6 minutes. At this time, the surface of the catalyst layer is cleaned.

Then, the differential signal transmission cable 171 is immersed in the electroless plating solution 135 in the electroless plating unit 111. Immersion time may be, for example, less than 10 minutes. In this case, an electroless plating layer is formed on the outer peripheral surface of the insulation layer. The electroless plating layer corresponds to the plating layer. The longer the immersion time in the electroless plating solution 135 is, the thicker the electroless plating layer becomes.

Then, the differential signal transmission cable 171 is immersed in the electroplating solution 139 in the electroplating unit 113. Immersion time may be, for example, less than 3 minutes. In this case, the electroplating layer is formed on the outer peripheral surface of the electroless plating layer. The electroplating layer corresponds to the plating layer. The longer the immersion time in the electroplating solution 139 is, the thicker the electroplating layer becomes. Specific conditions for electroplating in the electroplating unit 113 are as shown in Table 3. Through the above steps, the differential signal transmission cable 171 is completed.

TABLE 3

| | |
|---|---|
| cathode current density ($A/dm^2$) | 1-6 |
| anode current density ($A/dm^2$) | up to 2.5 |
| bath voltage (V) | 1-6 |
| stirring method | air stirring |
| filtration | continuous filtration, more than 3 times/hour |
| anode | phosphorus containing copper |
| anode pack | saran cloth made, etc. |

Although not described in FIG. 14, the differential signal transmission cable 171 is washed with pure water between the units. The method of washing includes ultrasonic cleaning, oscillating wash, running water cleaning or the like. Washing with pure water can suppress bringing residual drug deposited in the previous unit into the following unit.

Conveying speed of the differential signal transmission cable 171 can be appropriately adjusted. The conveying speed may be changed in the middle of the conveyance, or may be subjected to a temporary stop.

Figure 15:
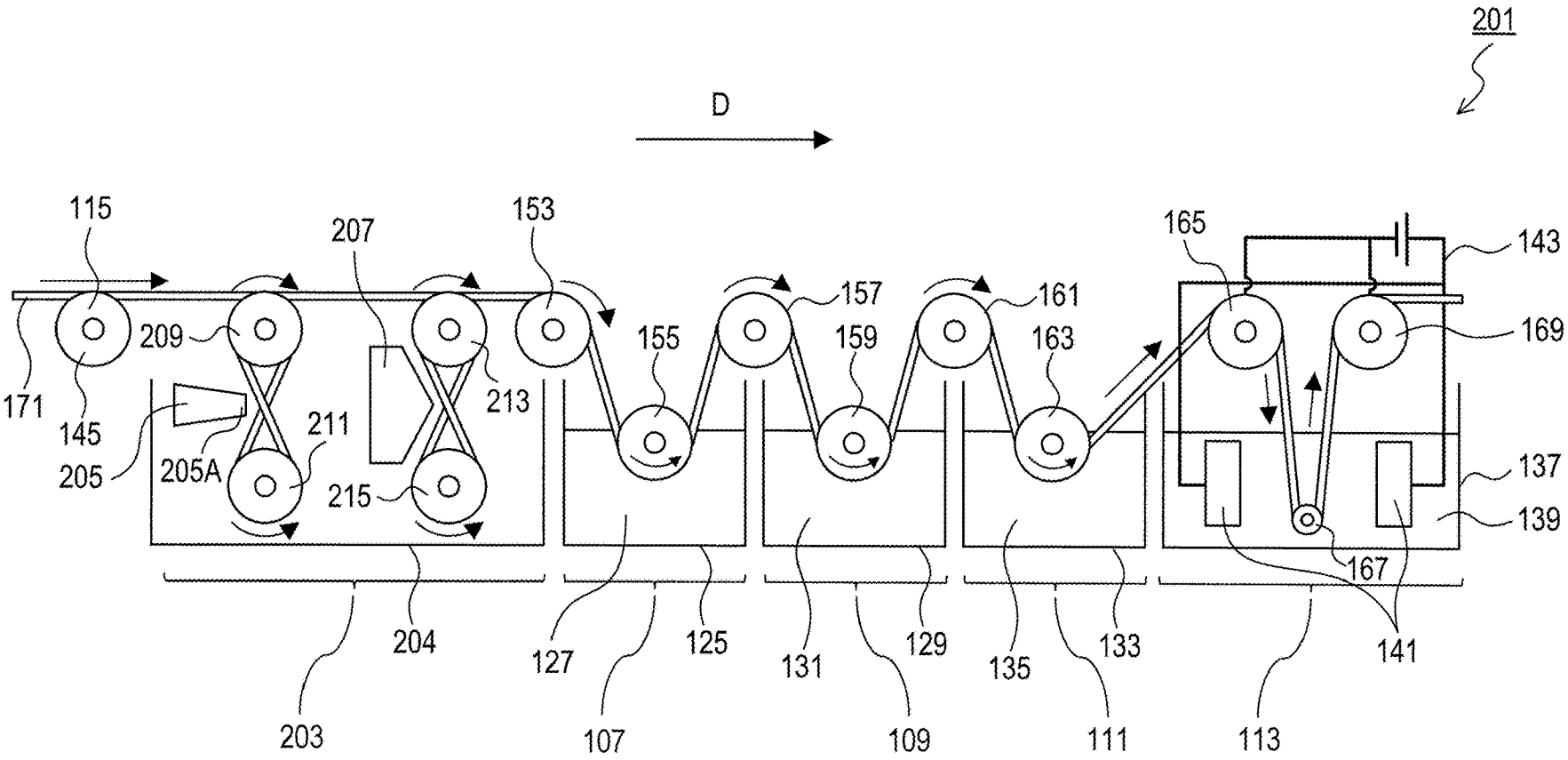
FIG. 15 is an explanatory diagram showing a configuration of the manufacturing system.
Figure 16:
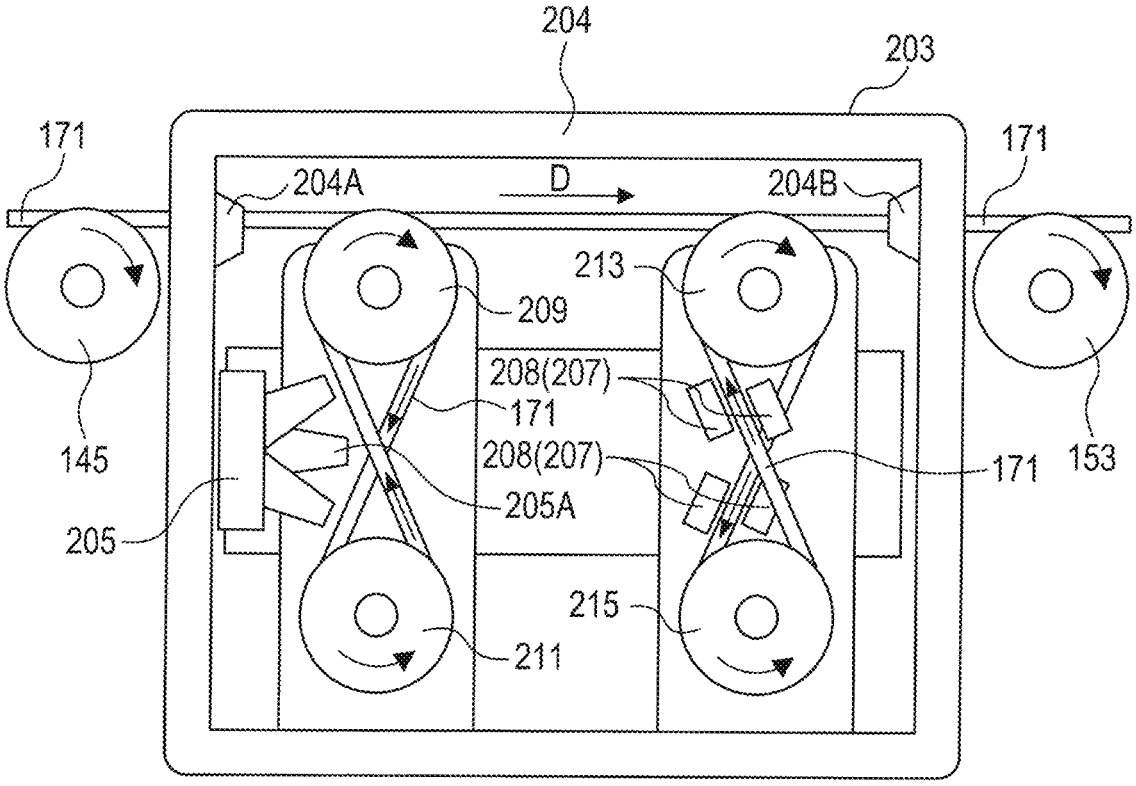
FIG. 16 is an explanatory view showing a configuration of a surface modification unit.

The differential signal transmission cable may be manufactured using a manufacturing system 201 shown in FIG. 15. Configuration of the manufacturing system 201 is basically the same as the manufacturing system 101, but there are some differences. The following explanation will focus on the differences. The manufacturing system 201 does not comprise the degreasing unit 103 and the wet etching unit 105, but comprises a surface modification unit 203. FIG. 16 represents a detailed configuration of the surface modification unit 203.

The surface modification unit 203 comprises a housing 204, a fine shape forming device 205, and a hydrophilic treatment apparatus 207. The housing 204 accommodates components of the surface modification unit 203. The housing 204 includes an inlet 204A at an upstream side in a direction D, and an outlet 204B at a downstream side in the direction D.

The conveying unit 115 comprises four bobbins 209, 211, 213, 215 in the housing 204. The differential signal transmission cable 171 is guided to the bobbin 145, and is introduced through the inlet 204A to the housing 204. The introduced differential signal transmission cable 171 is conveyed along a figure-eight path in which the differential signal transmission cable 171 is sent from the bobbin 209 to the bobbin 211 and returns to the bobbin 209 again. Then, the differential signal transmission cable 171 is conveyed along a figure-eight path in which the differential signal transmission cable 171 is sent from the bobbin 209 to the bobbin 213, further sent from the bobbin 213 to the bobbin 215, and returns to the bobbin 213 again. Then, the differential signal transmission cable 171 is guided out through the outlet 204B to the bobbin 153, and sent to the first activation unit 107.

The fine shape forming device 205 injects dry ice powder from the nozzle 205A into the differential signal transmission cable 171 which exists between the bobbin 209 and the bobbin 211. A driving force of the injection may be air pressure. The arithmetic average roughness Ra in the outer peripheral surface of the insulation layer is increased by collision with dry ice powder. Therefore, the fine shape forming device 205 performs dry ice blasting. Dry ice blasting corresponds to surface roughening treatment.

A surface facing the nozzle 205A of the outer peripheral surface of the insulation layer is reversed when the differential signal transmission cable 171 is sent from the bobbin 209 to the bobbin 211 and returns from the bobbin 211 to the bobbin 209. Therefore, the fine shape forming device 205 can increase the arithmetic average roughness Ra over the entire outer peripheral surface of the insulation layer.

Particle size of dry ice powder, distance from the tip of the nozzle 205A to the differential signal transmission cable 171, etc. can be set as appropriate. Temperature of the differential signal transmission cable 171 may be, for example, 20° C.

Conditions in dry ice blasting may be changed as appropriate. The conditions in dry ice blasting include, for example, particle size of dry ice powder, dry ice flow rate, air pressure, distance from the tip of the nozzle 205A to the differential signal transmission cable 171, conveying speed of the differential signal transmission cable 171, temperature of the differential signal transmission cable 171, and the like. For example, dry ice blasting may be performed at a temperature below a glass transition temperature of the material of the insulation layer. The temperature below the glass transition temperature of the material of the insulation layer may be, for example, −79° C. or more, and 20° C. or less. Position of the nozzle 205A may be fixed, or may be swung or scanned.

The hydrophilic treatment apparatus 207 performs a hydrophilic treatment by corona discharge exposure. Corona discharge exposure corresponds to surface modification treatment. As shown in FIG. 16, the hydrophilic treatment apparatus 207 comprises a total of four plate electrodes 208. Two plate electrodes 208 face each other across the differential signal transmission cable 171 which is sent from the bobbin 213 to the bobbin 215. The other two plate electrodes 208 face each other across the differential signal transmission cable 171 which returns from the bobbin 215 to the bobbin 213. By applying a high frequency high voltage between the opposite plate electrodes 208, corona discharge occurs. By exposure to corona discharge, the outer peripheral surface of the insulation layer is hydrophilized, and wettability is improved. When the outer peripheral surface of the insulation layer is hydrophilic and wettability is improved, the contact angle becomes smaller, and the absolute value of adhesion wetting surface free energy increases.

It is presumed that the reason why the outer peripheral surface of the insulation layer becomes hydrophilic by corona discharge exposure and wettability is improved is as follows. High energy electrons generated in the corona discharge exposure ionize and dissociate oxygen molecules present in air, and oxygen radicals, ozone, etc. are generated. At the same time, high energy electrons reaching the vicinity of the outer peripheral surface of the insulation layer cut and cleave the main chain or side chain of, for example, polyethylene, perfluoro ethylene propene copolymer or the like contained in the insulating layer. Oxygen radicals, ozone and the like generated by corona discharge recombine with the main chain or side chain cleaved as described above, and polar functional groups such as hydroxy group and carbonyl group are formed on the outer peripheral surface of the insulation layer. As a result, the outer peripheral surface of the insulation layer is hydrophilized, and wettability is improved.

Applied voltage in the corona discharge exposure is, for example, 2 kV to 14 kV, and the frequency may be 15 kV. A distance between the outer peripheral surface of the insulation layer and the plate electrode 208 may be, for example, 0.1 mm to 3 mm. Atmosphere in the housing 204, for example, may be air.

Conditions in the corona discharge exposure can be changed as appropriate. The conditions in the corona discharge exposure include, for example, magnitude of the applied voltage, frequency of the applied voltage, distance between the outer peripheral surface and the plate electrode 208 of the insulating layer, atmosphere in the housing 204 and the like. The atmosphere in the housing 204 may contain oxygen, nitrogen, carbon dioxide, rare gas and the like. Material such as silicone rubber may be interposed between the outer peripheral surface and the plate electrode 208 of the insulation layer. In this case, in performing corona discharge, the plate electrode 208 is in indirect contact with the insulating layer, and slides against the silicone rubber.

An exhaust mechanism for exhausting the air in the housing 204 or a drying device for drying the inside of the housing 204 may be provided. In this case, rust of the differential signal transmission cable 171 can be suppressed. It is also possible to provide grounding electrical equipment inside the housing 204. In this case, static electricity in the housing 204 can be suppressed.

As described above, in the manufacturing method of the differential signal transmission cable using the manufacturing system 201, dry ice blasting is performed on the outer peripheral surface of the insulation layer, and then, corona discharge exposure is performed on the outer peripheral surface of the insulation layer. Thereafter, permanganate treatment is performed, and a plating layer is formed on the outer peripheral surface of the insulation layer. Dry ice blasting corresponds to surface roughening treatment. Corona discharge exposure corresponds to surface modification treatment. By performing permanganate treatment, plating is easily attached to the insulating layer. Further, performing permanganate treatment improves transmission characteristics of the differential signal transmission cable. Permanganate treatment may be performed after the surface roughening treatment, and then corona discharge exposure may be performed.

Figure 17:
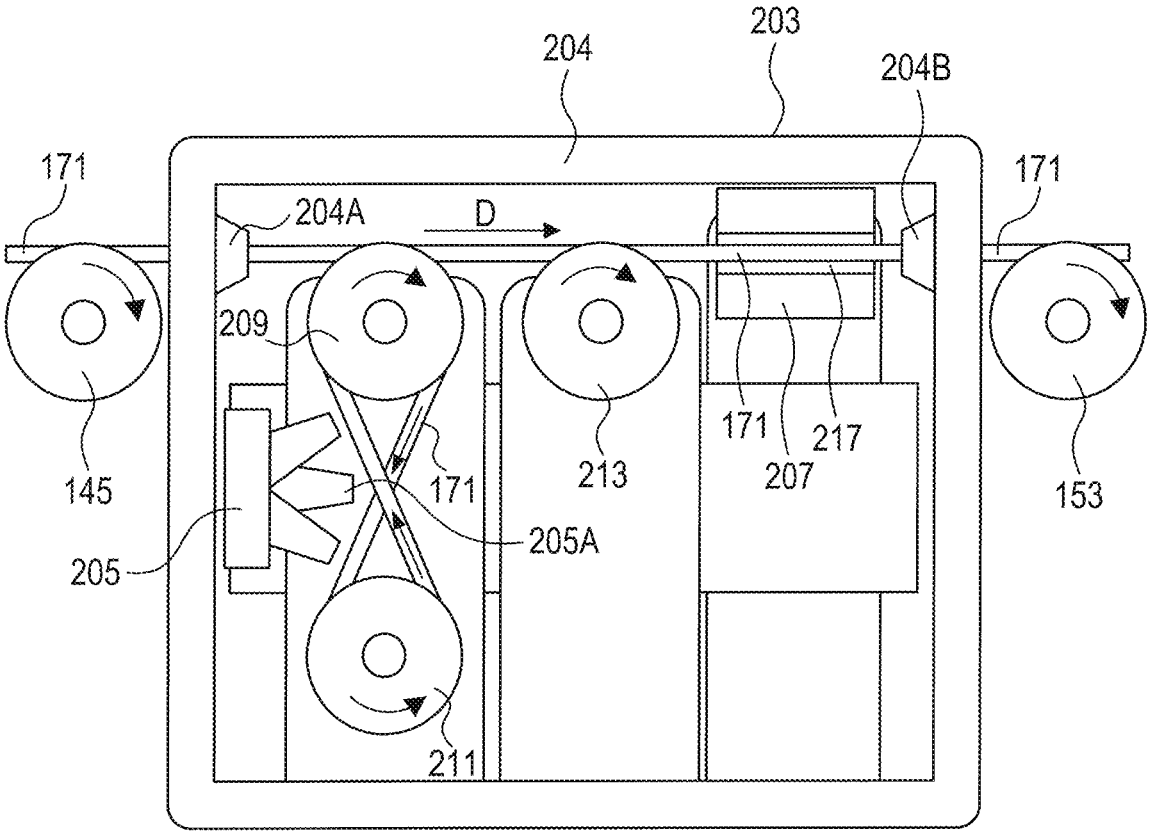
FIG. 17 is an explanatory diagram showing another configuration of the surface modification unit.

The surface modification unit 203 may have a configuration shown in FIG. 17. The surface modification unit 203 is provided with a hydrophilic treatment apparatus 207 having a cylindrical shape. The hydrophilic treatment apparatus 207 has a shaft hole 217. The differential signal transmission cable 171 which is conveyed by the bobbin 209 and the bobbin 213 passes through the shaft hole 217. The hydrophilic treatment apparatus 207 generates corona discharge in the shaft hole 217. Due to exposure to corona discharge, the outer peripheral surface of the insulation layer becomes hydrophilic, and wettability is improved. When the outer peripheral surface of the insulation layer is hydrophilic and wettability is improved, the contact angle becomes smaller, and the absolute value of adhesion wetting surface free energy increases. Corona discharge exposure corresponds to surface modification treatment.

Figure 18:
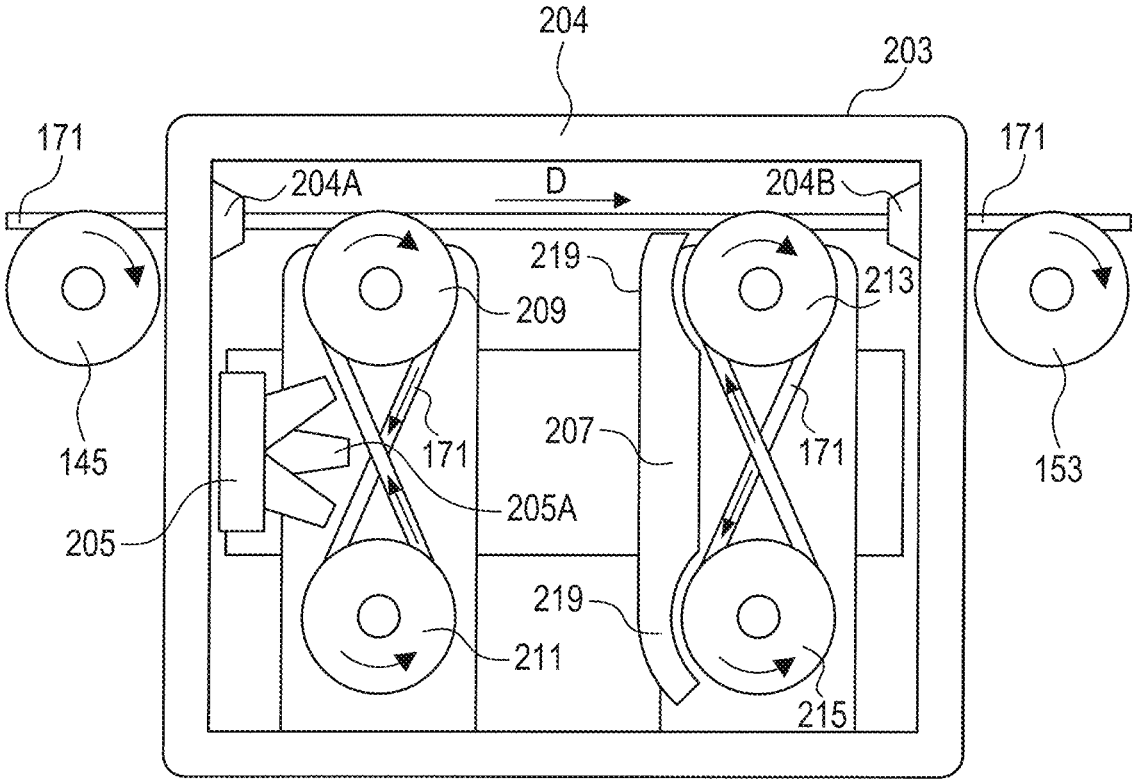
FIG. 18 is an explanatory view showing another configuration of the surface modification unit.

The surface modification unit 203 may have a configuration shown in FIG. 18. The hydrophilic treatment apparatus 207 comprises an arcuate electrode 219 at a portion facing the bobbin 213 and the bobbin 215. The bobbin 213 and the bobbin 215 are grounded to the earth. The hydrophilic treatment apparatus 207 applies a voltage between the electrode 219 and the bobbins 213 and 215, thereby generating corona discharge. Due to exposure to corona discharge, the outer peripheral surface of the insulation layer becomes hydrophilic, and wettability is improved. When the outer peripheral surface of the insulation layer becomes hydrophilic and wettability is improved, the contact angle becomes smaller and the absolute value of adhesion wetting surface free energy increases. Corona discharge exposure corresponds to surface modification treatment.

3. Multi-core Cable

The multi-core cable of the present disclosure comprises a plurality of differential signal transmission cable, a conductor layer, and a jacket. The conductor layer bundle-covers the plurality of differential signal transmission cable. The jacket covers the conductive layer. Each of the plurality of differential signal transmission cable is basically the same as the differential signal transmission cable described in the section "1. Differential signal transmission cable", and further comprises an outer insulating layer covering the plating layer.

The plurality of differential signal transmission cables may be twisted together, or may not be twisted. The number of differential signal transmission cables is not particularly limited, and can be, for example, 2, 8, 24 or the like. For example, the plurality of differential signal transmission cables may be divided into two or more groups, and an intervening may be provided between the groups. Each group comprises, for example, two or more differential signal transmission cables.

The conductor layer, for example, can be configured by a shielding tape conductor, a braided wire or the like. The conductive layer, for example, may be formed by laminating a shielding tape conductor and a braided wire. Material commonly used in the cable can be used for the material of the shielding tape conductor and the braided wire. Jacket material can be a material commonly used in the cable.

The outer insulating layer includes, for example, an insulating tape, a laminating tape, a film formed by spraying an insulator, or the like. The laminating tape includes, for example, a material commonly used in a flat cable or the like. It is preferable that the outer insulating layer can be formed at room temperature or low temperature. In this case, deformation of the insulation layer due to heat upon forming the outer insulating layer can be suppressed.

Material for the intervening includes, for example, paper, yarn, foam, and the like. The foam includes, for example, polyolefin foam such as foam polypropylene, foaming ethylene, and the like. The multi-core cable of the present disclosure can suppress an increase in differential-to-common mode conversion quantity.

Figure 19:
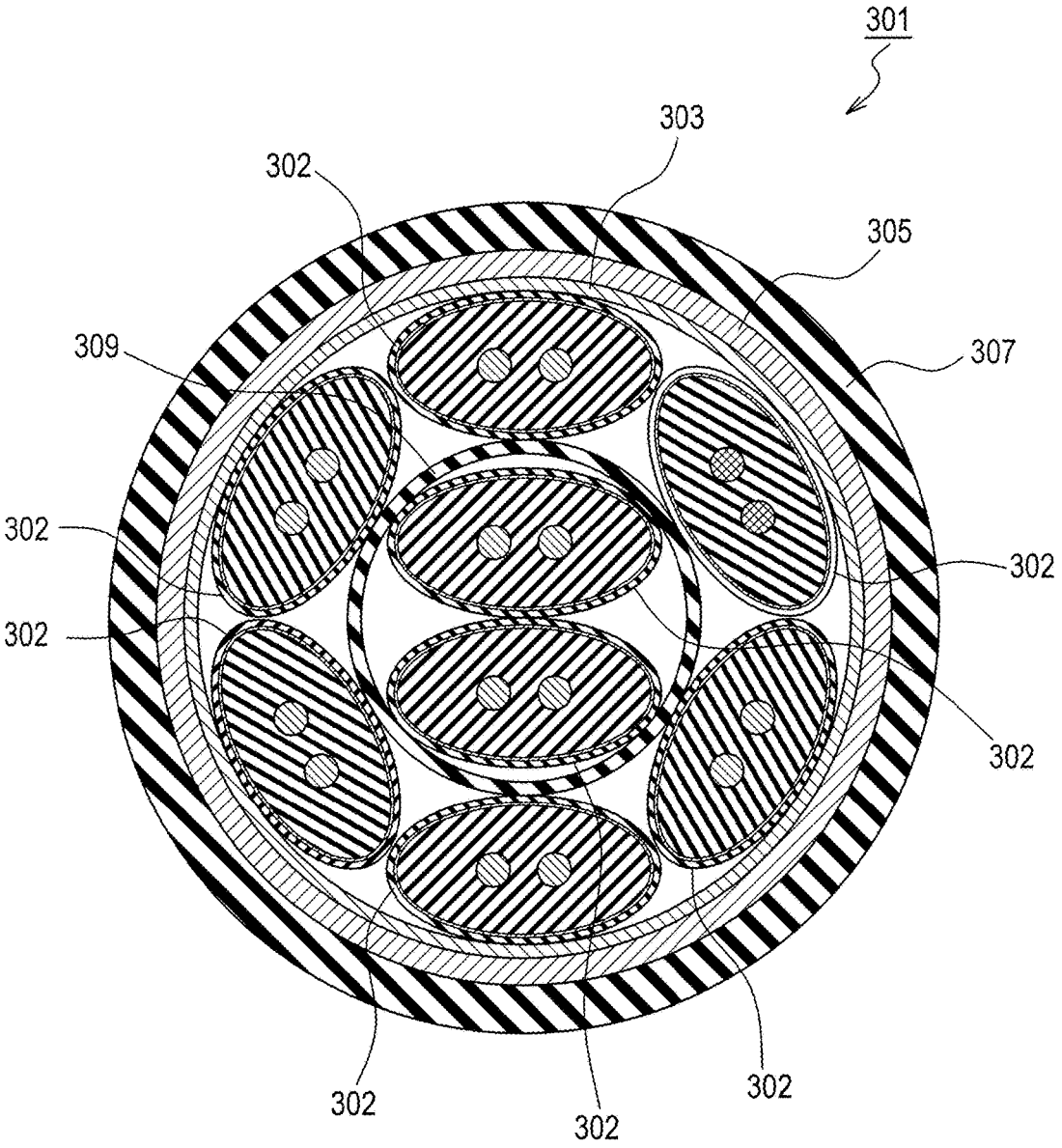
FIG. 19 is a cross-sectional view showing a configuration of a multi-core cable.

FIG. 19 shows an example of a multi-core cable 301. The multi-core cable 301 comprises eight differential signal transmission cables 302, a shielding tape conductor 303, a braided wire 305, and a jacket 307. The shielding tape conductor 303 and the braided wire 305 bundle-covers the eight differential signal transmission cables 302. The braided wire 305 is positioned on the outer peripheral side of the shielding tape conductor 303. The jacket 307 covers the braided wire 305.

The eight differential signal transmission cables 1 are divided into a group of two central cables, and a group of the surrounding cables. An intervening jacket 309 is provided between the two groups.

Each of the eight differential signal transmission cables 302 has a configuration shown in FIG. 20. The differential signal transmission cable 302 is provided with the two signal lines 3, the insulation layer 5, the plating layer 7, and an outer insulating layer 311.

The insulation layer 5 bundle-covers the two signal lines 3. The plating layer 7 covers the insulation layer 5. The outer insulating layer 311 covers the plating layer 7. In the differential signal transmission cable 302, the differential-to-common mode conversion quantity has a maximum value of −26 dB or less in the frequency band below 50 GHz. The arithmetic average roughness Ra in the outer peripheral surface of the insulation layer 5 is 0.6 μm to 10 μm. The configuration of the signal lines 3, the insulation layer 5, and the plating layer 7 may be, for example, the configuration described in the section "1. Differential signal transmission cable".

4. Embodiments (4-1) Embodiment 1

The differential signal transmission cable 1 of an embodiment having the configuration shown in FIG. 1 was manufactured. The insulating layer 5 may comprise polyethylene. The insulation layer 5 bundle-covers the two signal lines 3. In a cross section perpendicular to an extending direction of the two signal lines 3, the outer edge of the insulation layer 5 may have an elliptical shape. The plating layer 7 may have a thickness of 4.56 μm. A standard deviation of the thickness of the plating layer 7 may be 0.68 μm. A variation coefficient of the thickness of the plating layer 7 may be 0.15.

As shown in FIG. 20, an outer diameter of the insulation layer 5 in a major axis direction is L1. An outer diameter of the insulation layer 5 in a minor axis is L2. A distance between centers of the two signal lines 3 is L3. In the major axis direction, a distance between the center of the signal line 3 and the outer peripheral surface of the insulation layer 5 is L4. In the minor axis direction, a distance between the center of the signal line 3 and the outer peripheral surface of the insulation layer 5 is L5.

Even if the outer edge of the insulating layer 5 has an oval shape, L1 to L5 can be defined in the same manner. However, if an outer edge of the insulating layer 5 has an oval shape, the major axis direction is a direction parallel to two straight lines configuring the outer peripheral surface of the insulation layer 5. Further, if the outer edge of the insulating layer 5 has an oval shape, the minor axis direction is a direction perpendicular to the two straight lines described above.

In Embodiment 1, L1 is 2.03 mm. L2 is 1.04 mm. L3 is 0.55 mm. L4 is 0.74 mm. L5 is 0.52 mm.

The outer peripheral surface of the insulation layer 5 was subjected to surface roughening treatment. The surface roughening treatment is chromic acid etching. At the time before the plating layer 7 is formed, the arithmetic average roughness Ra in the outer peripheral surface of the insulation layer 5 is 0.6 μm. At the time before the plating layer 7 is formed, the contact angle at the outer circumferential surface of the insulation layer 5 may be less than or equal to 95°.

Figure 21:
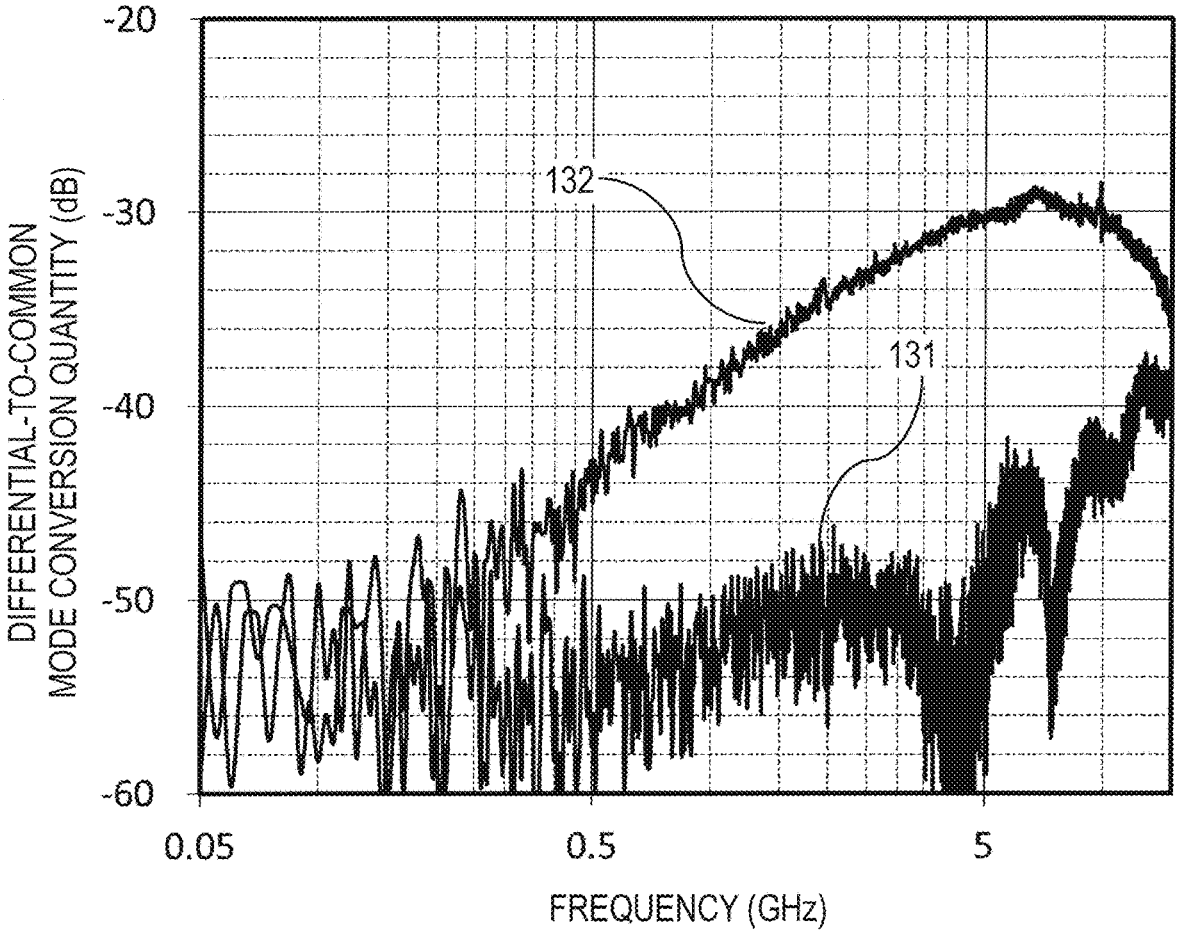
FIG. 21 is a graph showing the differential signal transmission cable and differential-to-common mode conversion quantity of the comparative example.

Differential-to-common mode conversion quantity of the differential signal transmission cable 1 was measured. Measurement of the differential-to-common mode conversion quantity was made prior to winding the differential signal transmission cable to a drum or the like. Measurement result is indicated in FIG. 21 by a reference numeral "131". The horizontal axis in FIG. 21 may be a frequency in a logarithmic scale. The vertical axis is the differential-to-common mode conversion quantity in dB. The differential-to-common mode conversion quantity of the vertical axis corresponds to Scd21 in the mixed-mode S-parameters. It represents that the larger the value of the vertical axis is (i.e., the smaller the absolute value of the negative measurement value is), the larger the amount of noise is in the differential-to-common mode conversion quantity, indicating that there is significant quality degradation of the transmission signal.

Further, differential-to-common mode conversion quantity of a differential signal transmission cable R of Comparative Example was also measured. A measurement result is indicated in FIG. 21 as "132". In the differential signal transmission cable R of Comparative Example, the outer peripheral surface of the insulation layer was not subjected to surface roughening treatment. Therefore, the arithmetic average roughness Ra in the outer peripheral surface of the insulation layer is 0.13 μm, and the contact angle in the outer peripheral surface of the insulation layer may be 82°. The differential signal transmission cable R of Comparative Example does not comprise the plating layer, and comprises a conductor layer wound with a metal tape.

The differential-to-common mode conversion quantity was small in the differential signal transmission cable 1 of Embodiment, as compared with the differential signal transmission cable R of Comparative Example. In particular, in the region of high frequencies, the difference from the differential signal transmission cable R of Comparative Example was remarkable.

Figure 22:
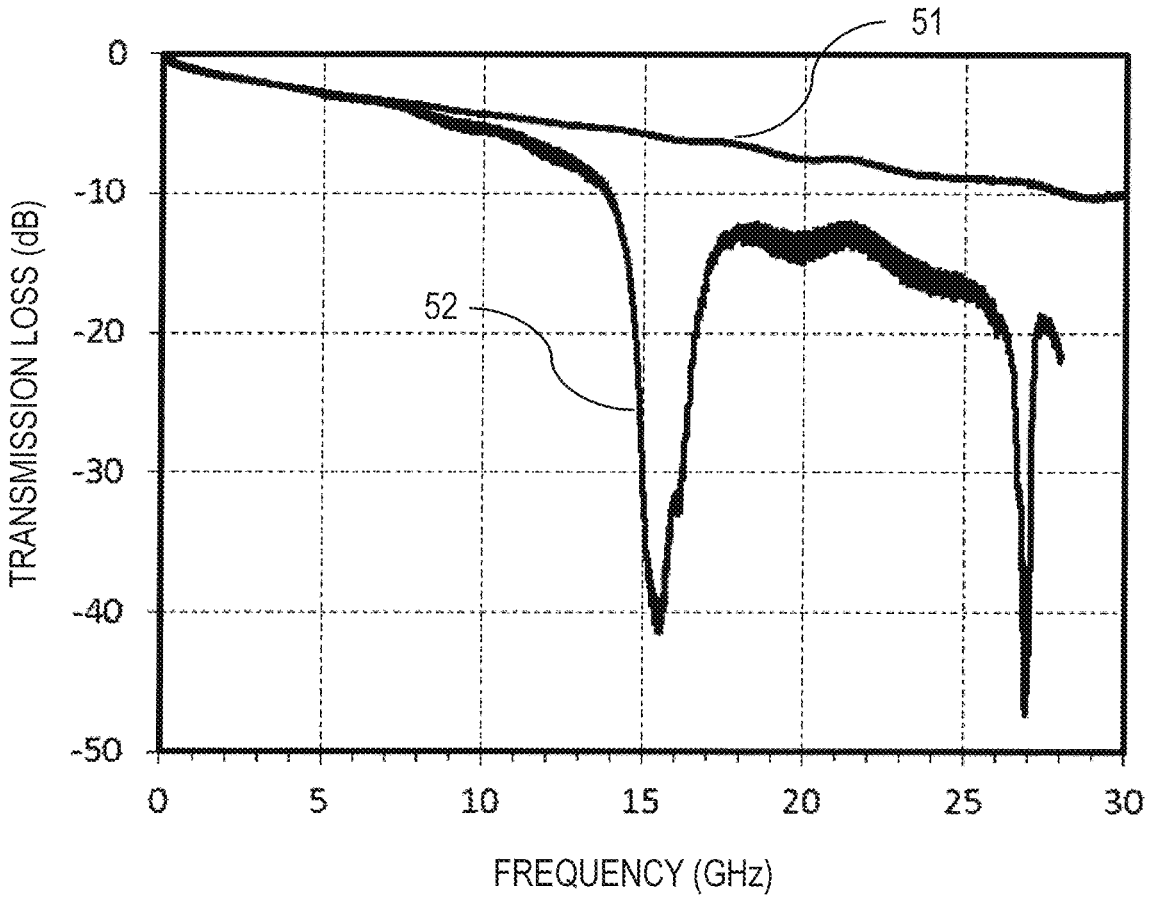
FIG. 22 is a graph showing the differential transmission cable and transmission loss of the comparative example.

Further, transmission characteristics of the differential signal transmission cable 1 of Embodiment and the differential signal transmission cable R of Comparative Example were measured. Measurement of transmission characteristics was performed prior to winding the differential signal transmission cable to a drum or the like. A measurement result of the differential signal transmission cable 1 of Embodiment is indicated in FIG. 22 as "51". A measurement result of the differential signal transmission cable R of Comparative Example is indicated as "52". The horizontal axis in FIG. 22 is a frequency of the transmission signal. The vertical axis represents transmission signal loss in dB. Transmission loss of the vertical axis corresponds to Sdd21 in the mixed-mode S-parameters. It represents that the smaller the value of the vertical axis is (i.e., the larger the absolute value of negative measurement value is), the larger attenuation of the transmission signal occurs, and the larger deterioration occurs due to transmission of the originating signal, indicating that there is significant transmission loss.

The transmission loss was small in the differential signal transmission cable 1 of Embodiment, as compared with the differential signal transmission cable R of Comparative Example. Further, suck-out did not occur in the differential signal transmission cable 1 of Embodiment. Although not shown in FIG. 22, suck-out did not occur in areas in 30 GHz to 50 GHz. Note that suck-out means a rapid attenuation of the transmission signal.

In contrast, suck-out occurred in the differential signal transmission cable R of Comparative Example. The reason why suck-out does not occur in the differential signal transmission cable 1 of Embodiment is presumed that the plating layer is continuously formed over the entire differential signal transmission cable 1, and there are no overlays and seams such as those found in a conductor layer wound with a metal tape.

(4-2) Embodiment 2

Differential signal transmission cables S1 to S7 were manufactured under the conditions shown in Table 4.

TABLE 4

| Sample No. | Pretreatment | Permanganate treatment | First Ra (μm) | Second Ra (μm) | Average Ra (μm) | 12.89 GHz Sdd21 |
|---|---|---|---|---|---|---|
| S1 | dry ice | Yes | 2.97 | 3.56 | 3.27 | −8.15 |
| S2 | blasting + | Yes | 3.23 | 1.49 | 2.36 | −8.14 |
| S3 | corona | Yes | 0.93 | 1.04 | 0.99 | −7.91 |
| S4 | discharge | No | 4.22 | 3.34 | 3.78 | −8.65 |
| S5 | | No | 1.33 | 1.20 | 1.27 | −8.32 |
| S6 | chromic acd treatment | — | — | — | 0.60 | −7.80 |
| S7 | Cu tape (lateral winding) | — | — | — | 0.08 | −7.50 |

All of S1 to S7 comprise an insulating layer comprising polyethylene. In any of S1 to S7, in a cross section orthogonal to an extending direction of the two signal lines 3, an outer edge of the insulating layer has an elliptical shape. In Embodiment 2, L1 may be 1.21 mm. L2 may be 0.62 mm. L3 may be 0.35 mm. L4 may be 0.43 mm. L5 may be 0.31 mm.

Each of S1 to S6 is provided with a conductive layer comprising a plating layer. In S7, a conductive layer was formed by laterally winding a Cu tape. In S1 to S5, an outer peripheral surface of the insulation layer is subjected to dry ice blasting, and then subjected to corona discharge exposure. Dry ice blasting corresponds to surface roughening treatment, and corona discharge exposure corresponds to surface modification treatment. In S1 to S3, permanganate treatment was performed after corona discharge exposure. In S4 to S5, permanganate treatment was not performed after corona discharge exposure. In S6, a chromic acid treatment was performed on the outer peripheral surface of the insulation layer. In S7, no treatment prior to winding the Cu tape was performed.

Figure 23:
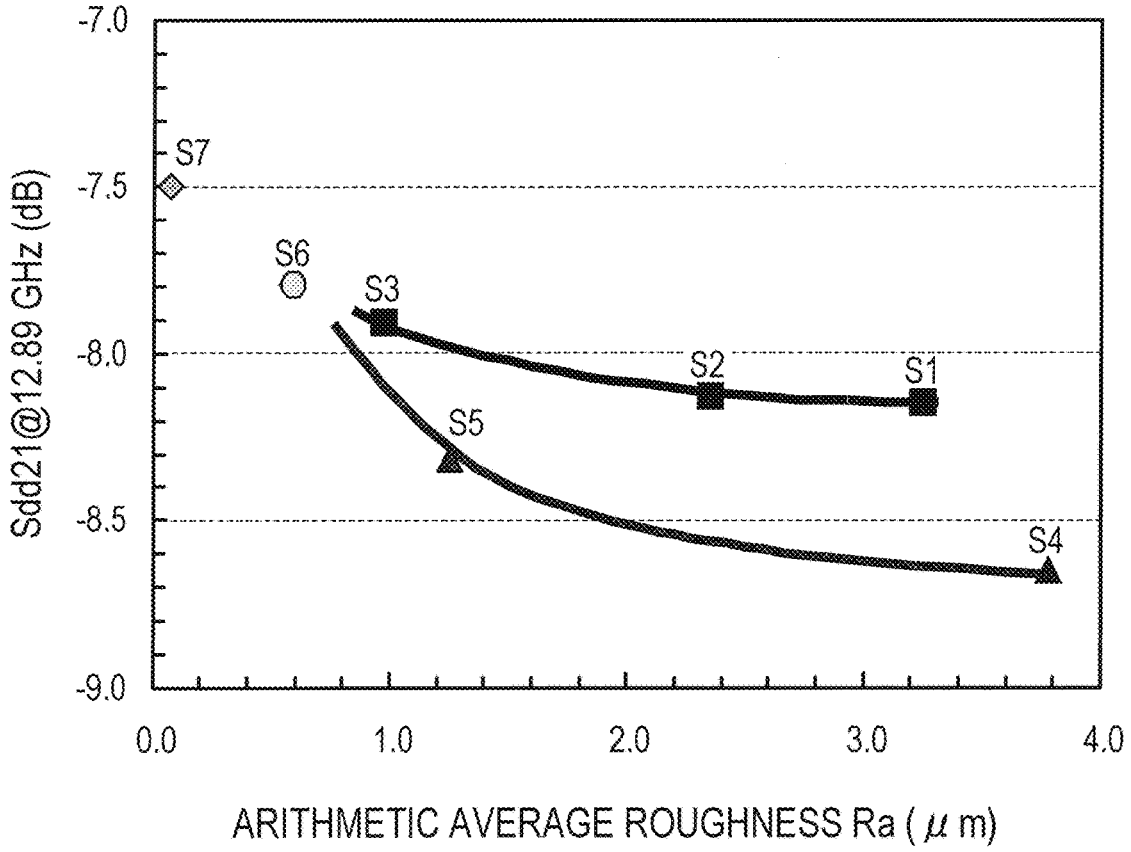
FIG. 23 is a graph showing a relationship between arithmetic average roughness Ra and transmission loss Sdd 21.

For S1 to S7, arithmetic average roughness Ra and transmission loss Sdd21 were measured. The result is shown in Table 4 above. "First Ra" in Table 1 represents arithmetic average roughness Ra at a first measuring position, "second Ra" represents arithmetic average roughness Ra at a second measuring position, and "average Ra" represents an average value thereof. Further, a relationship between arithmetic average roughness Ra and transmission loss Sdd21 is shown in FIG. 23. The smaller the arithmetic average roughness Ra was, the smaller the transmission loss Sdd21 was. The transmission loss in S1 to S3 in which permanganate treatment was performed was smaller than the transmission loss in S4 to S5 in which permanganate treatment was not performed.

5. Other Embodiments

The embodiments of the present disclosure have been described in the above, but the present disclosure is not limited to the above embodiments and can be modified in various ways.

(1) The function of a single component in each of the embodiments may be shared among the plurality of components or the function of a plurality of components may be exhibited by a single component. It is also possible to omit a part of the configuration of each of the above embodiments. Further, at least a part of the configuration of each of the above embodiments may be added, substituted, or the like, to the configuration of the other of the above embodiments. Any aspects within the technical idea specified from the wording of the claims may be an embodiment of the present disclosure.

(2) The present disclosure can be implemented in various forms, such as, other than the differential signal transmission cable or the multi-core cable mentioned above, a system including at least one of the differential signal transmission cable or the multi-core cable, a method of manufacturing a multi-core cable, a signal transmission and reception method using a differential signal transmission cable, and the like.

What is claimed is:

1. A differential signal transmission cable comprising:

two signal lines;

an insulation layer covering a periphery of the two signal lines; and a plating layer covering the insulation layer, differential-to-common mode conversion quantity of the differential signal transmission cable having a maximum value of −26 dB or less, in a frequency band of 50 GHz or less, wherein the insulation layer comprises polyethylene, wherein the polyethylene has a triclinic crystal structure, an orthorhombic crystal structure, or a state at least one of the triclinic crystal structure and the orthorohombic crystal structure, and is preferentially oriented to a specific axis not more than two axes among crystal axes and wherein a (100) crystalline orientation degree $O_{100}$ represented by Formula 2 below is 0.26 or less $$O_{100} = \frac{I_{200}}{I_{110} + I_{200}} \quad \text{[Formula 2]}$$

where I200 in Formula 2 is an X-ray diffraction intensity at index 200, and I110 is an X-ray diffraction intensity at index 110.

2. The differential signal transmission cable according to claim 1, wherein the insulation layer bundle-covers the two signal lines.

3. The differential signal transmission cable according to claim 1, wherein an outer edge of the insulation layer has a substantially oval or elliptical shape in a cross section orthogonal to an extending direction of the two signal lines.

4. The differential signal transmission cable according to claim 1, wherein the plating layer has a thickness of 1 μm to 5 μm.

5. The differential signal transmission cable according to claim 1, wherein a standard deviation of a thickness of the plating layer acquired at a total of sixteen points from four points in each of four cross sections perpendicular to an extending direction of the two signal lines is 0.8 μm or less.

6. The differential signal transmission cable according to claim 1, wherein an arithmetic average roughness Ra in an outer peripheral surface of the insulation layer is 0.6 μm or more.

7. The differential signal transmission cable according to claim 1, wherein a contact angle in an outer peripheral surface of the insulation layer is 95° or less.

8. The differential signal transmission cable according to claim 1, wherein an absolute value of adhesion wetting surface energy in an outer peripheral surface of the insulation layer is 66 $mJ/m^2$ or more.

9. The differential signal transmission cable according to claim 1, wherein the insulation layer has a recess on an outer circumferential surface of the insulation layer, wherein the recess has a portion wider than an opening at its inner part in a depth direction.

10. A multi-core cable comprising:

a plurality of differential signal transmission cables;

a conductor layer bundle-covering the plurality of differential signal transmission cables; and a jacket covering the conductor layer, each of the plurality of differential signal transmission cables comprising a differential signal transmission cable according to claim 1 and an outer insulation layer covering the plating layer.

11. A differential signal transmission cable comprising:

two signal lines;

an insulation layer covering a periphery of the two signal lines; and a plating layer covering the insulation layer, differential-to-common mode conversion quantity of the differential signal transmission cable having a maximum value of −26 dB or less, in a frequency band of 50 GHz or less, wherein the insulation layer comprises polyethylene or perfluoro ethylene propene copolymer, wherein when the insulation layer comprises polyethylene, crystallinity Xc represented by Formula 1 below is 0.744 or more, wherein when the insulation layer comprises perfluoro ethylene propene copolymer, crystallinity Xc represented by Formula 1 below is 0.47 or less $$X_c = \frac{I_c}{I_c + I_a}$$ [Formula 1]

where Ic in Formula 1 is an X-ray diffraction intensity of a crystalline component, and Ia is an X-ray diffraction intensity of an amorphous component.

12. The differential signal transmission cable according to claim 11, wherein the plating layer has a thickness of 1 μm to 5 μm.

13. The differential signal transmission cable according to claim 11, wherein a standard deviation of a thickness of the plating layer acquired at a total of sixteen points from four points in each of four cross sections perpendicular to an extending direction of the two signal lines is 0.8 μm or less.

14. The differential signal transmission cable according to claim 11, wherein the insulation layer has a recess on an outer circumferential surface of the insulation layer, wherein the recess has a portion wider than an opening at its inner part in a depth direction.

15. A multi-core cable comprising:

a plurality of differential signal transmission cables;

a conductor layer bundle-covering the plurality of differential signal transmission cables; and a jacket covering the conductor layer, each of the plurality of differential signal transmission cables comprising a differential signal transmission cable according to claim 11 and an outer insulation layer covering the plating layer.

16. A differential signal transmission cable comprising:

two signal lines;

an insulation layer covering a periphery of the two signal lines; and a plating layer covering the insulation layer, differential-to-common mode conversion quantity of the differential signal transmission cable having a maximum value of −26 dB or less, in a frequency band of 50 GHz or less, wherein the insulation layer comprises polyethylene or perfluoro ethylene propene copolymer, wherein when the insulation layer comprises polyethylene, crystallite size in a crystalline component of polyethylene is at least 18 nm or more, wherein when the insulation layer comprises perfluoro ethylene propene copolymer, crystallite size in a crystalline component of perfluoro ethylene propene copolymer is 13.6 nm or less.

17. The differential signal transmission cable according to claim 16, wherein the plating layer has a thickness of 1 μm to 5 μm.

18. The differential signal transmission cable according to claim 16, wherein a standard deviation of a thickness of the plating layer acquired at a total of sixteen points from four points in each of four cross sections perpendicular to an extending direction of the two signal lines is 0.8 μm or less.

19. The differential signal transmission cable according to claim 16, wherein the insulation layer has a recess on an outer circumferential surface of the insulation layer, wherein the recess has a portion wider than an opening at its inner part in a depth direction.

20. A multi-core cable comprising:

a plurality of differential signal transmission cables;

a conductor layer bundle-covering the plurality of differential signal transmission cables; and a jacket covering the conductor layer, each of the plurality of differential signal transmission cables comprising a differential signal transmission cable according to claim 16 and an outer insulation layer covering the plating layer.

* * * * *